US007478896B2

(12) United States Patent
Ito et al.

(10) Patent No.: US 7,478,896 B2
(45) Date of Patent: Jan. 20, 2009

(54) INK JET HEAD

(75) Inventors: Koji Ito, Gifu (JP); Koji Nakayama, Seki (JP); Hiroshi Murashima, Nagoya (JP); Takuji Hashiguchi, Kokubu (JP)

(73) Assignees: Kyocera Corporation, Kyoto-shi, Kyoto (JP); Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 328 days.

(21) Appl. No.: 11/242,790

(22) Filed: Oct. 5, 2005

(65) Prior Publication Data

US 2006/0071959 A1 Apr. 6, 2006

(30) Foreign Application Priority Data

Oct. 5, 2004 (JP) ..... 2004-292180

(51) Int. Cl.
*B41J 2/015* (2006.01)
*B41J 2/045* (2006.01)

(52) U.S. Cl. ..... 347/20; 347/71; 347/72

(58) Field of Classification Search ..... 347/69–73, 347/9, 20

See application file for complete search history.

(56) References Cited

U.S. PATENT DOCUMENTS

| | | | | |
|---|---|---|---|---|
| 5,936,644 | A * | 8/1999 | Ono et al. | 347/10 |
| 6,345,887 | B1 | 2/2002 | Sato | |
| 2003/0112298 | A1 | 6/2003 | Sato et al. | |
| 2004/0113994 | A1 * | 6/2004 | Shinkai | 347/68 |
| 2006/0071959 | A1 | 4/2006 | Ito et al. | |

FOREIGN PATENT DOCUMENTS

| | | | |
|---|---|---|---|
| CN | 2908153 | Y | 6/2007 |

(Continued)

OTHER PUBLICATIONS

European Search Report for Application No. EP 05 25 6218, mailed Jan. 30, 2006.

(Continued)

*Primary Examiner*—Julian D Huffman
*Assistant Examiner*—Jason S Uhlenhake
(74) *Attorney, Agent, or Firm*—Banner & Witcoff, Ltd.

(57) ABSTRACT

An ink jet head is presented that decreases the density in wiring patterns to be connected to a large number of actuator terminals formed on a main body of the ink jet head while ensuring large spacing between the wirings. The ink jet head comprises a main body, a driver IC, and a sheet. The main body comprises a plurality of nozzles, a plurality of pressure chambers, a plurality of actuators, and a plurality of actuator terminals distributed on a surface of the main body. The driver IC can select any actuator terminal among the plurality of actuator terminals and transmit a driving voltage to the selected actuator terminal. The sheet mounts the driver IC at a first surface of the sheet and is fixed to the main body at a second surface. The sheet comprises a plurality of input terminals, a plurality of output terminals distributed on the second surface, a plurality of first wirings connecting the input terminals and the driver IC, and a plurality of second wirings connecting the driver IC and the output terminals. Output terminals of the sheet are connected to the actuator terminals of the main body. The second wiring penetrates the sheet.

21 Claims, 15 Drawing Sheets

FOREIGN PATENT DOCUMENTS

| | | |
|---|---|---|
| EP | 1 029 678 | 8/2000 |
| JP | 11-179903 | 7/1999 |
| JP | 2001-113700 | 4/2001 |
| JP | 2002-036568 | 2/2002 |
| JP | 2002-210955 | 7/2002 |

OTHER PUBLICATIONS

English Translation of Notification of First Office Action for Chinese Patent Application No. 200510113416.5, Issued Dec. 14, 2007.

* cited by examiner (a)

(b)

INK JET HEAD

CROSS-REFERENCE TO RELATED APPLICATION

This application claims priority to Japanese Patent Application No. 2004-292180 filed on Oct. 5, 2004, the contents of which are hereby incorporated by reference into the present application.

BACKGROUND OF THE INVENTION

1. Field of the Invention

The present invention relates to an ink jet head that prints on a sheet by discharging ink onto the sheet. The ink jet head of the present invention is usually incorporated into an ink jet printer.

2. Description of the Related Art

One type of ink jet heads includes a main body and a flexible printed circuit (FPC) board.

The main body is equipped with a plurality of nozzles, a plurality of pressure chambers, a plurality of actuators, and a plurality of electrodes. Each nozzle is connected to a uniquely corresponding pressure chamber. Each pressure chamber is coupled with a uniquely corresponding actuator. Each actuator is connected to a uniquely corresponding electrode. When a driving voltage is applied to a selected electrode, ink within the pressure chamber coupled with the actuator connected to the selected electrode is pressed and ink is discharged from the nozzle connected to the pressure chamber. The number of the plurality of nozzles, the number of the plurality of pressure chambers, the number of the plurality of actuators, and the number of the plurality of electrodes are equal. The plurality of electrodes is distributed on a surface of the main body.

A plurality of wirings is formed on the FPC. The number of the plurality of wirings is equal to the number of the plurality of electrodes, and an output contact is formed on an end of each wiring. A positioning pattern of the plurality of electrodes and a positioning pattern of the plurality of output contacts are identical. One end of the FPC is fixed to the surface of the main body. Each electrode is connected to a uniquely corresponding output contact when one end of the FPC is fixed to the surface of the main body. This type of ink jet head is taught in Japanese Laid-Open Patent Application Publication No. 2002-36568.

BRIEF SUMMARY OF THE INVENTION

With prior art ink jet heads, it is necessary to form an equal number of wirings as the number of nozzles, and consequently it is necessary to form the wirings highly densely. In order to form the wirings very densely, an expensive micromachining device is required. Consequently, the cost of manufacturing the FPC increases.

Within the recent years, in order to meet demands of higher resolution or faster printing of images, there is a trend to position the nozzles highly densely. In other words, there is a trend towards increasing the number of nozzles. As a result, there is a trend towards rising manufacturing cost of the FPC.

Alternatively, a limit is approaching where spacing between the wirings become too packed and the wirings cannot be formed any more densely. Since the number of wirings becomes restricted, increasing the density of the nozzles also becomes restricted.

One object of the present invention is to provide an art that can decrease the density in a wiring pattern for applying driving voltages to a large number of actuators formed on the main body of the ink jet head.

Another object of the present invention is to provide wirings for applying driving voltages to the actuators while ensuring large spacing between the wirings.

If the spacing between the wirings is large, a precise micromachining technology is not required and the wirings can be manufactured less expensively.

Further another object of the present invention is to provide an art that can increase the number of wirings without reducing the spacing between the wirings so that a further densification of the nozzles becomes possible.

An ink jet head of the present invention includes a main body, a driver IC, and a sheet. The main body is equipped with a plurality of nozzles, a plurality of pressure chambers, a plurality of actuators, and a plurality of actuator terminals. Each nozzle is connected to a uniquely corresponding pressure chamber. Each pressure chamber is coupled with a uniquely corresponding actuator. Each actuator is connected to a uniquely corresponding actuator terminal. When a driving voltage is applied to a selected actuator terminal, ink within the pressure chamber coupled with the actuator connected to the selected actuator terminal is pressed and ink is discharged from the nozzle connected to the pressure chamber.

The driver IC is able to select any actuator terminal among the plurality of actuator terminals and transmit the driving voltage to the selected actuator terminal.

The driver IC is mounted on a first surface of the sheet, and the sheet is fixed to the main body at a second surface. The sheet comprises a plurality of input terminals, a plurality of output terminals distributed on the second surface, a plurality of first wirings connecting the input terminals and the driver IC, and a plurality of second wirings connecting the driver IC and the output terminals. The second wirings penetrate the sheet from the first surface to the second surface.

Each output terminal formed on the sheet is connected to a uniquely corresponding actuator terminal formed on the main body.

The driver IC has a plurality of input contacts and a plurality of output contacts distributed on a surface of the driver IC. This driver IC can select any output contact among the plurality of output contacts and transmit the driving voltage to the selected output contact. When utilizing this driver IC, it is preferable to use the sheet described hereinafter. In other words, the driver IC is mounted on the first surface of the sheet, and the sheet is fixed to the main body at the second surface. This sheet includes a plurality of input terminals, a plurality of first intermediate terminals distributed on the first surface, a plurality of second intermediate terminals distributed on the first surface, a plurality of output terminals distributed on the second surface, a plurality of first wirings connecting the plurality of input terminals and the plurality of first intermediate terminals, and a plurality of second wirings connecting the plurality of second intermediate terminals and the plurality of output terminals. The second wirings penetrate the sheet from the first surface to the second surface.

Each first intermediate terminal is connected to a uniquely corresponding input contact of the driver IC, each output contact of the driver IC is connected to a uniquely corresponding second intermediate terminal, and each output terminal is connected to a uniquely corresponding actuator terminal of the main body.

When the sheet described above is utilized, wirings to connect to the plurality of actuator terminals formed on the main body can be formed by the combination of wirings penetrating the sheet and the wirings extending along the sheet, and the required density of the wirings can be lowered.

The number of the input terminals of the sheet and input contacts of the driver IC is smaller than the output contacts of the driver IC, output terminals of the sheet and actuator terminals of the main body. High density wirings are not required to connect to input contacts of the driver IC through input terminals of the sheet, because the number of the input contacts of the driver IC is relatively small. Also high density wirings are not required between the output contacts of the driver IC and actuator terminals of the main body because the sheet of the invention can be used. High density wirings are not required in this invention.

BRIEF DESCRIPTION OF THE DRAWINGS

FIG. 6(*b*) shows an enlarged planar view of an individual electrode and an actuator terminal of the actuator unit illustrated in FIG. 6(*a*).

DETAILED DESCRIPTION OF THE INVENTION

Figure 1:
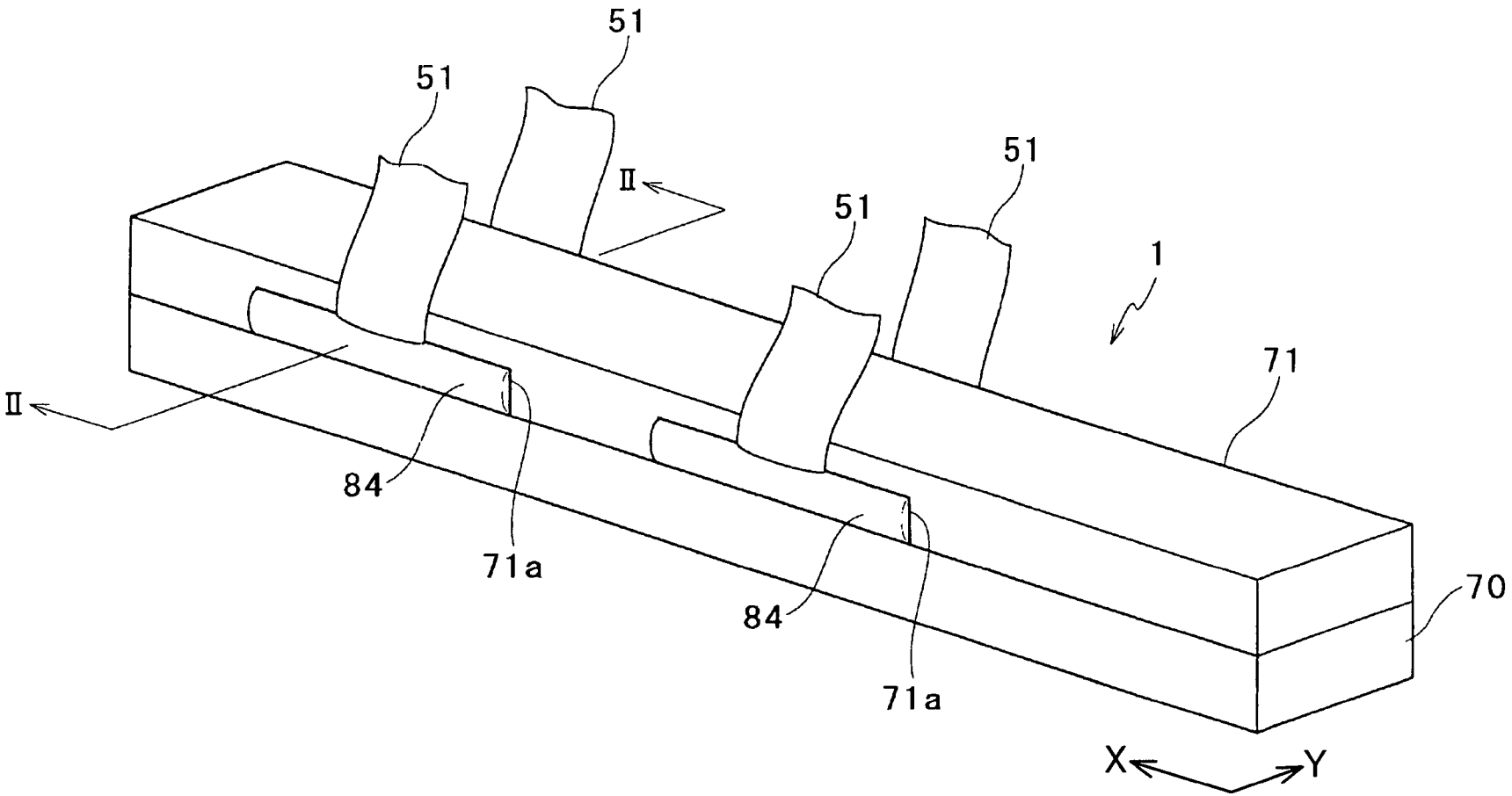
FIG. 1 shows an external perspective view of an ink jet head of a first embodiment of the present invention.

As will be described, it is preferable that the plurality of input terminals and the plurality of first wirings are formed on the first surface of the sheet. The sheet and the main body can be directly fixed to one another. There is no need to use an expensive FPC in the prior art, which has a large number of densely formed wirings.

It is preferable that the sheet further comprises a constant voltage input terminal, a constant voltage output terminal formed on the second surface, and a constant voltage wiring connecting the constant voltage input terminal and the constant voltage output terminal. The constant voltage may be a grounded voltage. In this situation, it is preferable that the constant voltage wiring penetrates the sheet, and covers nearly an entire area of the first surface of the sheet except the region where the driver IC is mounted, the region where the input terminals are formed, and the region where the first wirings are formed.

According to the present invention, a relationship can be attained where the number of the plurality of second wirings is equal to the number of the plurality of nozzles and the number of the plurality of second wirings is larger than the number of the plurality of first wirings.

Consequently, the number of wirings necessary to connect to the main body (in this invention, the sheet is fixed to the main body and may be considered as a part of the main body) can be reduced. Compared to prior art, cost of manufacturing the wiring member to connect to the main body can be reduced.

It is preferable that the sheet comprises a plurality of stacked layers. It is also preferable that a part of the second wirings is formed on a surface of each layer.

In this situation, the second wirings can be divided and formed on multiple layers. It is acceptable to have only the part of the second wirings formed on each layer. On each layer, large spacing is maintained between the wirings. An advanced micro-machining technology is not required.

It is preferable that the plurality of actuator terminals is distributed on a surface of the main body to form a matrix pattern, and the plurality of output terminals is distributed on the second surface of the sheet to form the same matrix pattern. In this case, the second wirings can be formed with a simple pattern. Also, it is easy to connect the plurality of actuator terminals and the plurality of output terminals.

It is preferable that the driver IC is mounted at a central portion of the first surface of the sheet. Since it becomes possible to extend the second wirings in any direction from the driver IC, the pitch between the second wirings can be made larger.

It is preferable that the main body comprises a channel unit that has the plurality of pressure chambers formed on one surface and an actuator unit that is fixed to the same surface of the channel unit. The main body can be easily manufactured.

It is preferable that the main body further comprises a reservoir unit. The reservoir unit is fixed on the above mentioned same surface of the channel unit and stores ink to supply to the channel unit. In this situation, it is preferable that the driver IC is thermally coupled with the reservoir unit. In this structure, heat generated by the driver IC can be efficiently dissipated via the reservoir unit through which ink flows. In addition, since there is no need to prepare a separate heat dissipating fin or block, a miniaturization of an ink jet head can be realized. To say that the driver IC and the reservoir unit are thermally coupled means that there is a correlation in temperature change between the driver IC and the reservoir unit.

It is preferable that a gap is formed between the reservoir unit and the channel unit, and that the actuator unit, the sheet, and the driver IC are located within that gap. This allows the compact storage of the actuator unit, the sheet, and the driver IC.

It is preferable that the gap is filled with a sealing material. The actuator unit, the driver IC, and the sheet can be protected from ink-spray or dust by the sealing material.

The plurality of actuator units may be fixed to the channel unit, and the sheet mounting the driver IC may be fixed to each actuator unit. In this situation, a large actuator unit is not necessary and the cost of manufacturing the actuator unit can be reduced. Alternatively, an ink jet head larger than the actuator unit can be realized.

When using a plurality of driver ICs, it is preferable that the plurality driver ICs is connected in a cascade connection. According to this structure, the number of input terminals formed on the sheet can be reduced. Therefore, the number of wirings necessary for the wiring member connected to the sheet can be reduced.

It is preferable that the plurality of actuator units is fixed to the channel unit, the sheet is fixed to the plurality of actuator units, and the same number of driver ICs as the number of the actuator units is mounted on the sheet. According to this structure, the necessary number of sheet can be reduced.

It is preferable that the plurality of output terminals is distributed to form a matrix pattern and the sheet comprises a plurality of stacked insulating layers. In this situation, it is preferable that a part of the second wirings connected to the output terminals at a first row is formed on a surface of a first insulating layer, a part of the second wirings connected to the output terminals at a second row is formed on a surface of a second insulating layer, and a part of the second wirings connected to the output terminals at a third row is formed on a surface of a third insulating layer.

On the surface of each insulating layer, large spacing between wirings can be maintained. An advanced micromachining technology is not required.

It is preferable that the part of the second wirings formed on the surface of an n-th insulating layer is connected to the second intermediate terminals via through-holes penetrating first to (n−1)-th insulating layers and connected to the output terminals via through-holes penetrating (n+1)-th to m-th insulating layers. In the above explanation, "m" is the total number of the insulating layers and "n" is any number selected from "1" to "m".

In this situation, the part of the second wirings formed on the surface of each insulating layer connects the driver IC and the main body via through-holes.

First Embodiment

Figure 2:
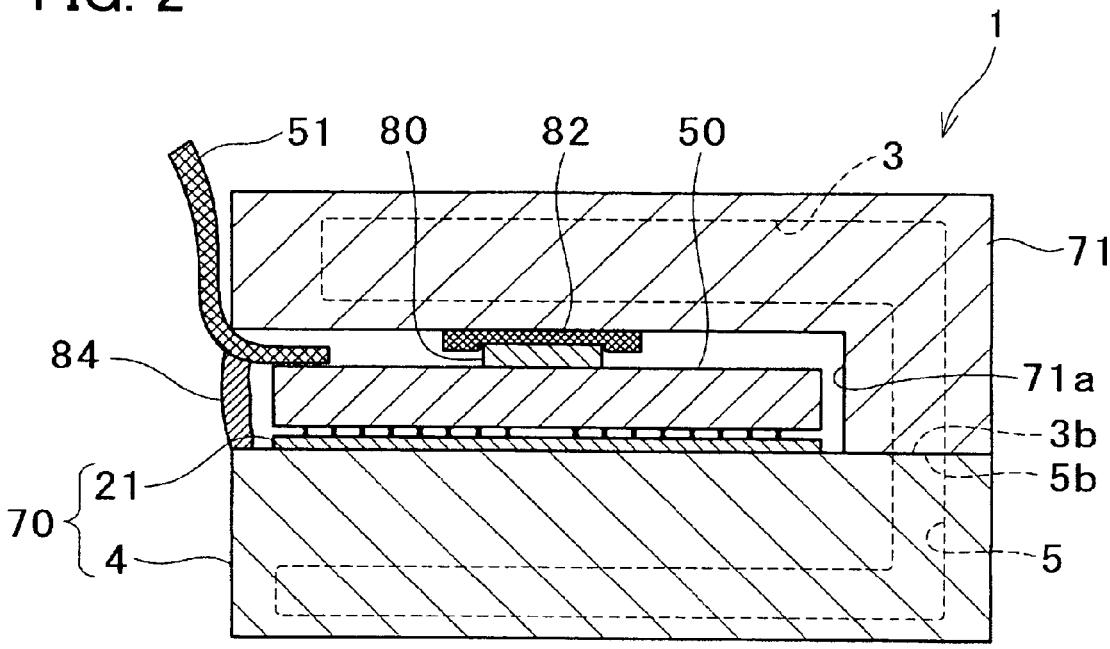
FIG. 2 shows a cross-sectional view along line II-II shown in FIG. 1.

A first embodiment of the present invention will be described with reference to the figures. FIG. 1 shows an external perspective view of an ink jet head of the first embodiment. FIG. 2 shows a cross-sectional view along line II-II of FIG. 1.

Ink jet head 1 is mounted on an ink jet printer. Ink jet head 1 includes main body 70, ink reservoir unit 71, sheets 50 (refer to FIG. 2), driver ICs 80 (refer to FIG. 2), and FFCs (flat flexible cable) 51.

As shown in FIG. 2, main body 70 includes channel unit 4 and actuator unit 21 that is attached to an upper surface of channel unit 4.

As will be described in detail hereinafter, channel unit 4 is equipped with an internal manifold channel 5, a plurality of nozzles formed on a bottom surface and a plurality of pressure chambers formed on an upper surface. The plurality of nozzles is distributed on the bottom surface of channel unit 4, and the plurality of pressure chambers is distributed on the upper surface of channel unit 4. A plurality of ink channels is formed within channel unit 4. Each ink channel guides ink from manifold channel 5 to each pressure chamber, and then guides the ink from each pressure chamber to a uniquely corresponding nozzle.

As shown in FIG. 1, main body 70 extends in the X direction, and a sheet for printing is sent in the Y direction. The length of main body 70 in the X direction is equal to the length of the sheet in the X direction. Main body 70 can squirt ink on any location of the sheet in the X direction. By adjusting ink discharge timing, main body 70 can squirt ink on any location of the sheet in the Y direction.

Figure 3:
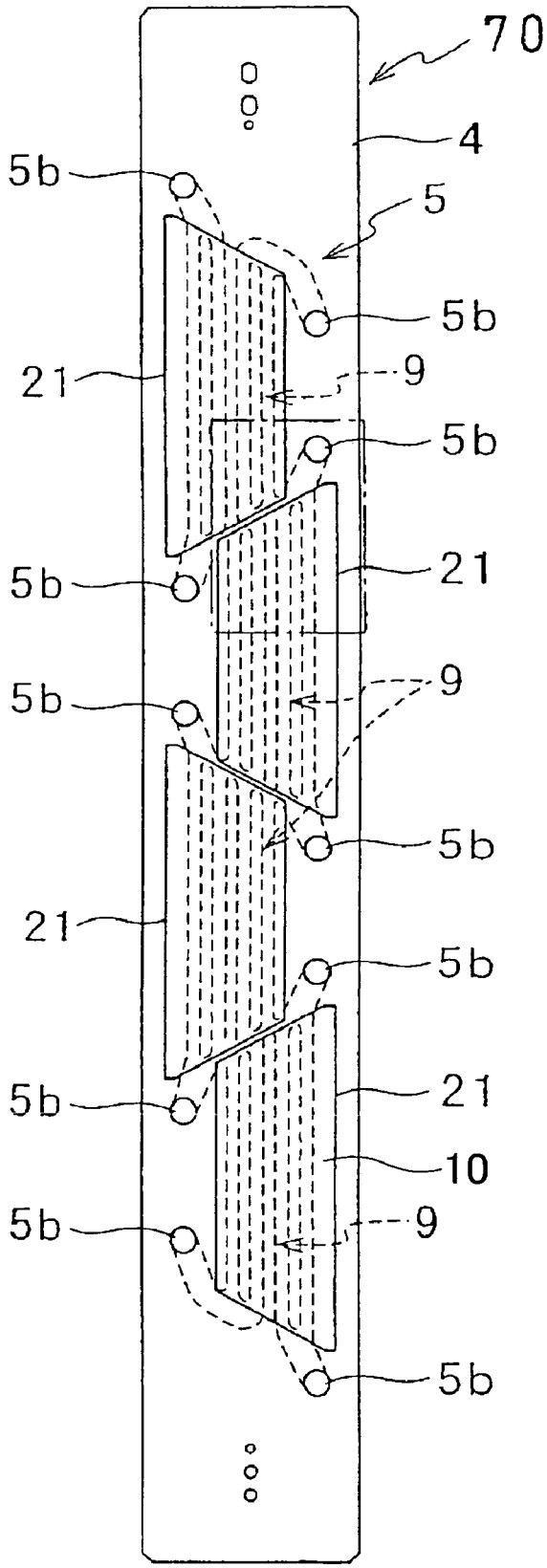
FIG. 3 shows a top planar view of the main body shown in FIG. 1.

As shown in FIG. 3, a plurality of pressure chambers 10 is distributed on the upper surface of channel unit 4. Four actuator units 21 are fixed so as to cover the plurality of pressure chambers 10.

As shown in FIG. 2, sheet 50 is fixed on an upper surface of each actuator unit 21. Driver IC 80 is mounted on an upper surface of sheet 50. Four sets of driver ICs 80, sheets 50 and actuator units 21 are used in main body 70.

Ink reservoir unit 71 is fixed on the upper surface of channel unit 4 in an area not covered by actuator units 21. As shown in FIG. 2, ink reservoir unit 71 has a cross-sectional shape of an L. Therefore, gap 71*a* is formed between the upper surface of channel unit 4 and a bottom surface of ink reservoir unit 71. Actuator unit 21, sheet 50, and driver IC 80 are located within gap 71*a*. Between an upper surface of driver IC 80 and the bottom surface of ink reservoir unit 71, heat dissipation sheet 82 is disposed as to contact both driver IC 80 and ink reservoir unit 71. By utilizing heat dissipation sheet 82 of high heat conductance, driver IC 80 and ink reservoir unit 71 are coupled in a condition where the heat conductance is good with respect to one another. In other words, the correlation of temperature between driver IC 80 and ink reservoir unit 71 is high. In the present embodiment, this condition will be referred to as being thermally coupled.

Ink reservoir unit 71 has internal ink reservoir 3. As will be described hereinafter, ink reservoir 3 is connected to manifold channel 5 of channel unit 4. Ink reservoir 3 stores ink to be supplied to channel unit 4.

Ink reservoir unit 71 is made of metallic material such as, for example, stainless steel. Within ink reservoir unit 71, a midair region nearly rectangular in shape and extending in the longitudinal direction (X direction) is formed. This midair region is ink reservoir 3. Ink reservoir 3 comprises a connection opening (not shown) to connect to an ink tank not shown in the figures, and ink is supplied from the ink tank to ink reservoir 3 via the connection opening. Ink reservoir unit 71 is connected to channel unit 4 so that opening 3*b* of ink reservoir 3 and opening 5*b* of manifold channel 5 match each other.

On a bottom surface of ink reservoir unit 71, four depressions are formed to correspond to four sets of actuator units 21, sheets 50 and driver ICs 80. Between each depression and the upper surface of channel unit 4, gap 71*a* is formed. Corresponding set of actuator unit 21, sheet 50, and driver IC 80 is disposed within each gap 71*a*.

As described hereinafter, sheet 50 is a multi-layered sheet formed by stacking a plurality of glass epoxy sheets that use epoxy resin that is of insulating material. On an upper surface, driver IC 80 is mounted. Driver IC 80 is a bare chip configured as an ASIC (Application Specific Integrated Circuit), and outputs a driving signal that drives actuator unit 21 based on a control signal from a higher control device not shown in the figures. In addition, as described hereinafter, first writings to transmit the control signal from the higher control device to driver IC 80 and second wirings to transmit the driving signal from driver IC 80 to actuator unit 21 are formed on sheet 50. FFC (flat flexible cable) 51 to transmit the control signal from the higher control device is connected to each sheet 50. FFC 51 is pulled out from the opening from gap 71*a* and connected to the higher control device, not shown in the figures, of the ink jet printer. This FFC 51 is provided with a number of wirings to correspond to input terminals 61 described hereinafter, but that number is considerably less than the number of output terminals 75 described hereinafter (same number as the number of pressure chambers 10 and nozzles 8). The wiring density of FFC 51 is low, and can be manufactured at a low cost. Silicon (sealing material) 84 is applied to the opening section of gap 71*a*, and seals gap 71*a*.

Figure 4:
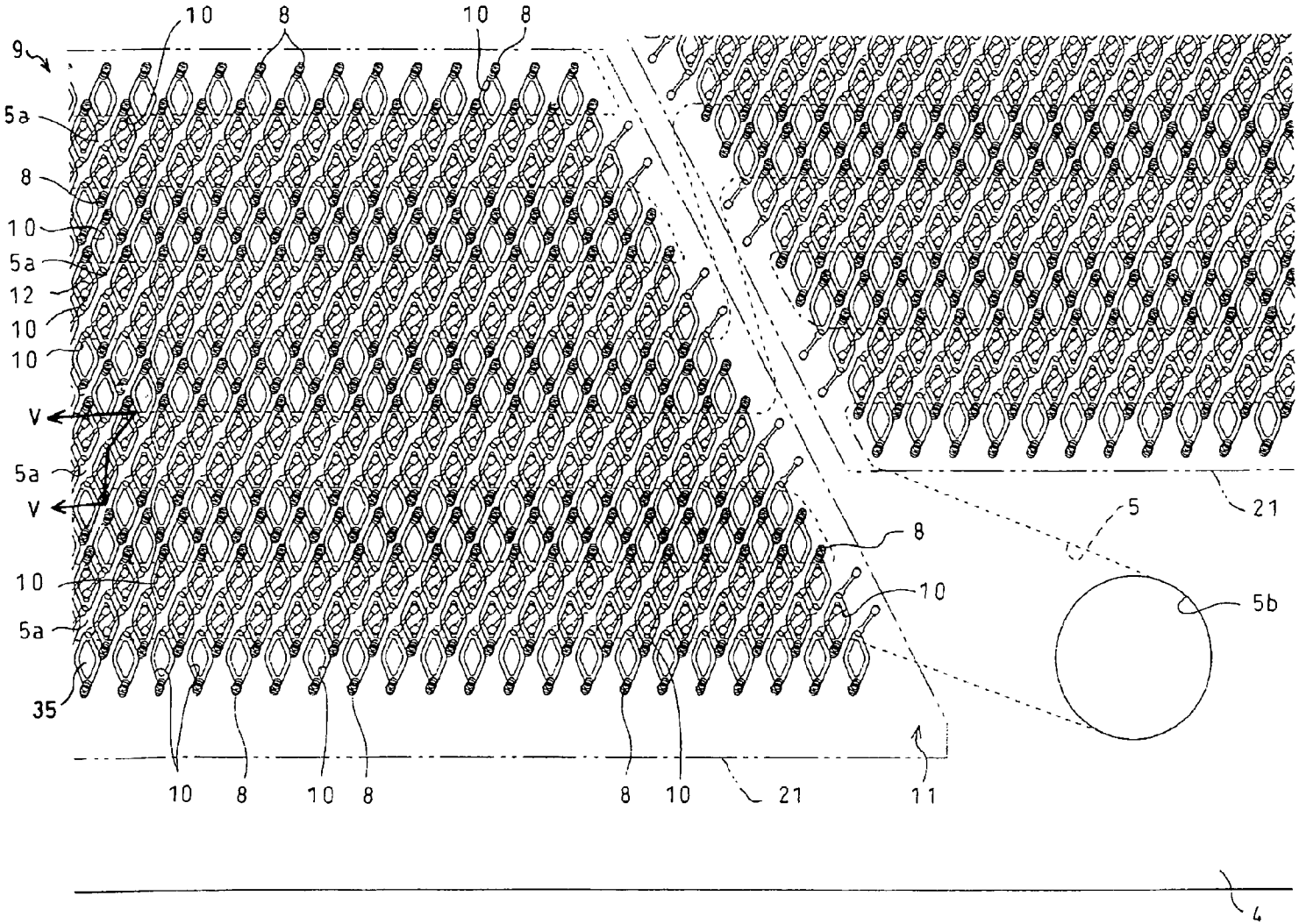
FIG. 4 shows an enlarged view of the region framed by the dashed lines illustrated in FIG. 3.

Next, with reference to FIG. 3 and FIG. 4, the details of main body 70 will be described. FIG. 3 shows a top planar view of main body 70 shown in FIG. 1. FIG. 4 shows an enlarged planar view of the region framed by the dashed lines in FIG. 3. As shown in FIG. 3 and FIG. 4, a large number of pressure chambers 10 are distributed to form a plurality of rows on the upper surface of channel unit 4 of main body 70. On the upper surface of channel unit 4, four actuator units 21 are attached. Each actuator unit 21 is shaped as a trapezoid. Each actuator unit 21 is disposed so that its parallel sides (upper side and lower side) lie along the longitudinal direction of channel unit 4 (X direction). In addition, the oblique sides of adjacent actuator units 21 overlap in the width direction of channel unit 4. Two actuator units 21 are located on a line extending along Y direction at a boundary between the two actuator units 21.

The bottom surface of channel unit 4 is an ink discharging surface. On the ink discharging surface, a large number of nozzles 8 (refer to FIG. 4 and FIG. 5) is aligned in rows. The large number of nozzles 8 is formed within a region opposing to actuator units 21 and pressure chambers 9. A single nozzle 8 corresponds to a single pressure chamber 10. As described hereinafter, a single individual electrode 35 formed on actuator unit 21 faces a uniquely corresponding pressure chamber 10.

Figure 5:
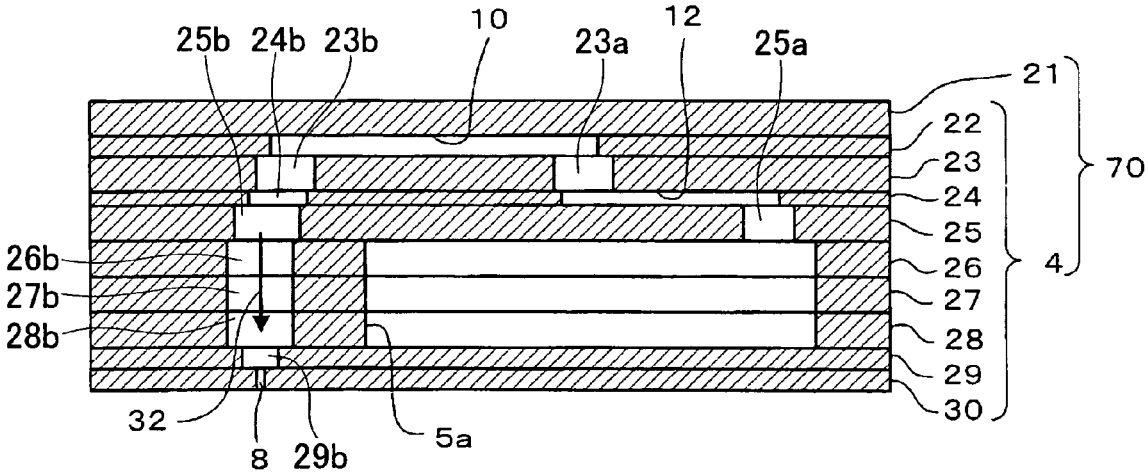
FIG. 5 shows a cross-sectional view along line V-V shown in FIG. 4.

As shown in FIG. 5, manifold channel 5, which is a common ink chamber, and sub-manifold channels 5*a*, which is a bifurcating channel, are formed within channel unit 4. Four sub-manifold channels 5*a* that extend towards the longitudinal direction of channel unit 4 (X direction) are formed to supply ink to the plurality of pressure chambers. As shown in FIG. 3, openings 5*b* of manifold channel 5 set up on the upper surface of channel unit 4 is connected to openings 3*b* of ink reservoir 3 (refer to FIG. 2). Therefore, ink is supplied via ink reservoir 3 from an ink tank not shown in the figures to manifold channel 5 and sub-manifold channels 5*a*.

As shown in FIG. 5, each nozzle 8 is connected to one of sub-manifold channels 5*a* via ink channel 32, pressure chamber 10 and aperture 12. Nozzles 8, included in the four adjacent rows, which extend towards the longitudinal direction of channel unit 4 (X direction), are connected to the same sub-manifold channel 5*a*. In order to make FIG. 4 easier to understand, actuator unit 21 is drawn in double-dashed lines and pressure chambers 9 (plurality of pressure chambers 10) and nozzles 8, which should have been drawn with broken lines, are drawn in solid lines. The planar shape of each pressure chamber 10 is approximately rhomboid.

Each nozzle 8 is formed at a location where a projective point, formed when these nozzles 8 are orthogonally projected on a virtual line extending in the longitudinal direction of channel unit 4 (X direction), line up with equal spacing at 600 dpi.

Next, with reference to FIG. 5, channel unit 4 will be described in detail. FIG. 5 shows a cross-sectional view along line V-V of FIG. 4. As shown in FIG. 5, main body 70 is a stacked combination of channel unit 4 and actuator unit 21. Further, channel unit 4 bears a stacked structure where, from top to bottom, cavity plate 22, base plate 23, aperture plate 24, supply plate 25, manifold plates 26, 27, and 28, cover plate 29 and nozzle plate 30 are stacked on top of one another.

Cavity plate 22 is a metallic plate with a large number of holes (the plurality pressure chambers 10). Each hole is shaped approximately rhombus. Base plate 23 is a metallic plate with a large number of connecting holes 23*b*, to connect each pressure chamber 10 to a uniquely corresponding nozzle 8, and a large number of connecting holes 23*a*, to connect each pressure chamber 10 to a uniquely corresponding aperture 12. Aperture plate 24 is a metallic plate with a large number connecting holes 24*b*, to connect each pressure chamber 10 to the uniquely corresponding nozzle 8, and a large number of holes for forming apertures 12. Supply plate 25 is a metallic plate with a large number connecting holes 25*b*, to connect each pressure chamber 10 to the uniquely corresponding nozzle 8, and a large number of connecting holes 25*a*, to connect each aperture 12 to sub-manifold channel 5*a*. Manifold plates 26, 27, and 28 are metallic plates with a large number of connecting holes 26*b*, 27*b*, and 28*b*, to connect each pressure chamber 10 to the uniquely corresponding nozzle 8, and a connecting hole 26*a*, 27*a*, and 28*a* for forming sub-manifold channel 5*a*. Cover plate 29*b* is a metallic plate with a large number of connecting holes 29*b*, to connect each pressure chamber 10 to the uniquely corresponding nozzle 8. Nozzle plate 30 is a metallic plate with a large number of nozzles 8. These nine metallic plates are stacked to align with each other in such a way that ink channel 32, which connects each nozzle 8 to sub-manifold channel 5*a* via corresponding pressure chamber 10 and aperture 12, is formed.

Figure 6:
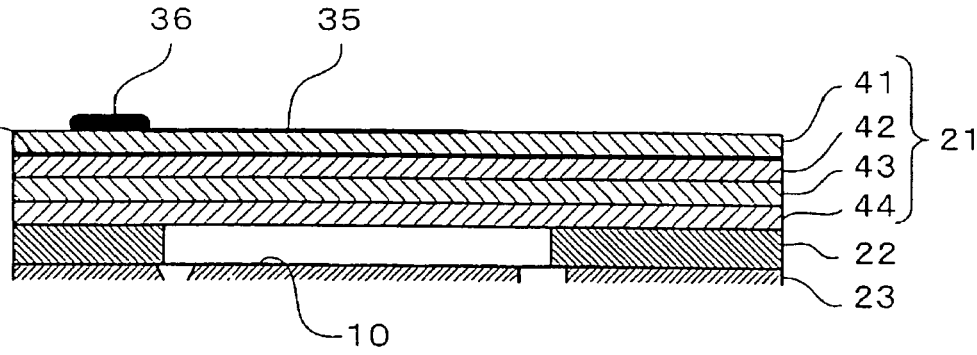
FIG. 6(*a*) shows an enlarged cross-sectional view of an actuator unit illustrated in FIG. 5.
Figure 6:
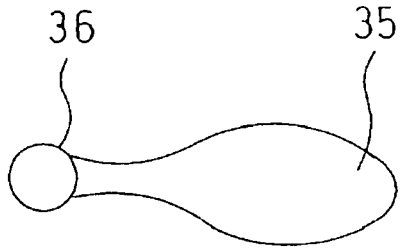
Figure 7:
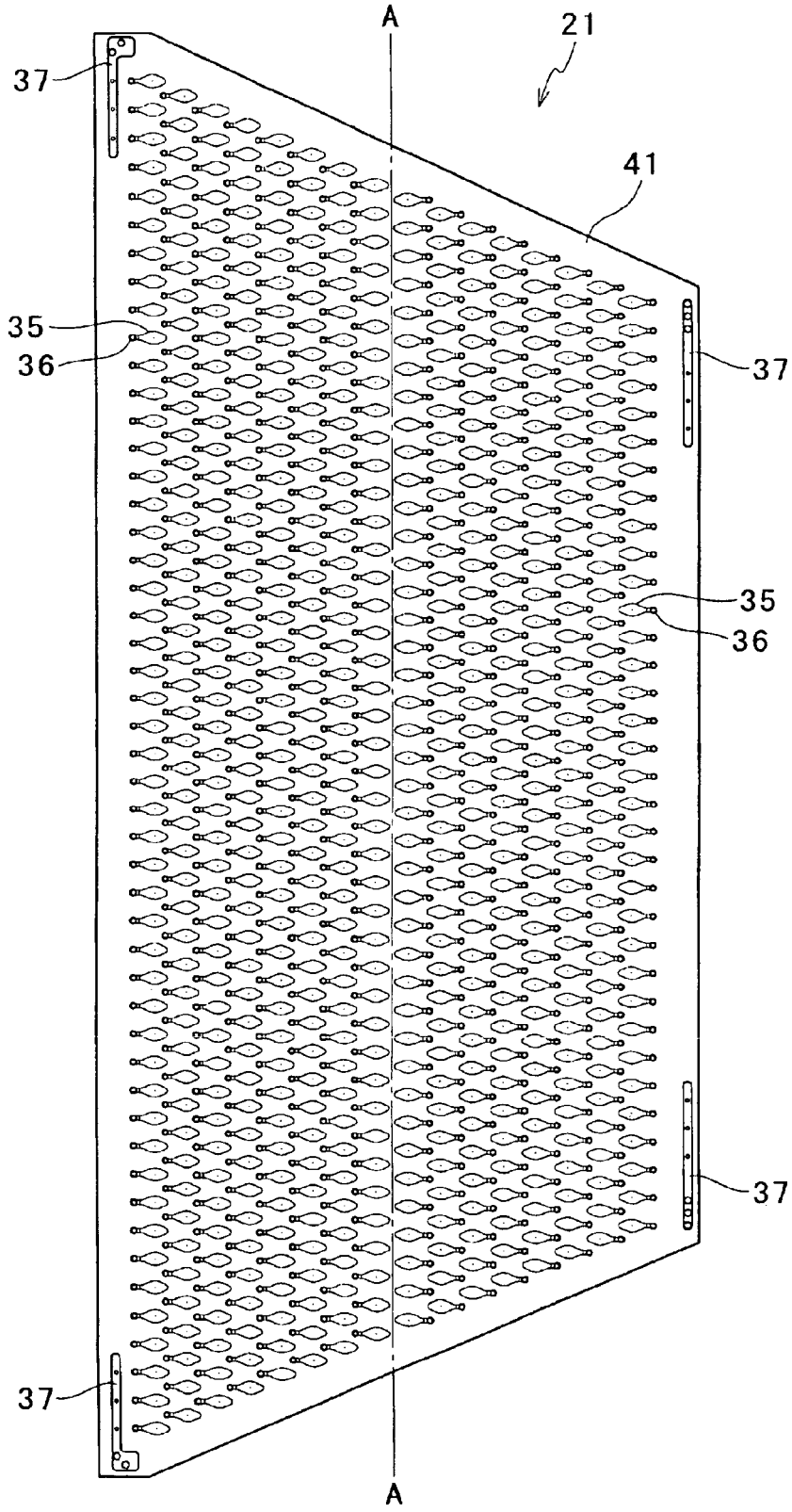
FIG. 7 shows a top planar view of the actuator unit shown in FIG. 2.

Next, with reference to FIG. 6 and FIG. 7, a configuration of actuator unit 21 will be described in detail. FIG. 6(*a*) is a partially enlarged cross-sectional view of actuator unit 21 and pressure chamber 10, and FIG. 6(*b*) is a top planar view showing the shape of individual electrode 35 formed on the surface of actuator unit 21. FIG. 7 is a top planar view of actuator unit 21 in its entirety.

As shown in FIG. 6(*a*), actuator unit 21 bears a stacked structure where four piezoelectric sheets 41, 42, 43, and 44 are stacked on top of one another. These piezoelectric sheets 41 to 44 are each approximately 15 μm thick. Each of piezoelectric sheets 41~44 are flat sheets, laminated back to back and positioned to straddle the large number of pressure chambers 10 within main body 70. Piezoelectric sheets 41~44 are made of ceramic material of lead zirconate titanate (PZT), which bears ferroelectric properties.

Formed on the upper surface of the uppermost layer, piezoelectric sheet 41, is a plurality of individual electrodes. Each individual electrode 35 faces a uniquely corresponding pressure chamber 10. Common electrode 34 with a thickness of approximately 2 μm, formed on the entire surface of a sheet, lies between the uppermost layer, piezoelectric sheet 41, and piezoelectric sheet 42 positioned below. Individual electrode 35 and common electrode 34 are both made of metallic material such as of type Ag—Pd. No electrodes are disposed between piezoelectric sheet 42 and piezoelectric sheet 43, or between piezoelectric sheet 43 and piezoelectric sheet 44.

Individual electrode 35 is approximately 1 μm thick, and as shown in FIG. 6(*b*), its planar shape is approximately rhomboid. The planar shape of individual electrode 35 is nearly the same as the planner shape of pressure chamber 10 shown in FIG. 4. As shown in FIG. 6(*b*), one of the thin ends of rhomboid-shaped individual electrode 35 extends outward, and actuator terminal 36 of circular shape with a diameter of approximately 160 μm is set up on the tip of that end. Actuator terminal 36 is made from gold including, for example, glass frit, and as shown in FIG. 6(*a*), is formed in a location which does not face pressure chambers 10. One actuator terminal 36 is connected to one individual electrode 35.

As shown in FIG. 7, when actuator unit 21 is viewed from top, individual electrodes 35 and actuator terminals are disposed in a matrix pattern. Each individual electrode is positioned so as to face a uniquely corresponding pressure chamber 10, in a one-to-one correspondence. The distribution pattern of the pressure chambers and the distribution pattern of the individual electrodes are identical.

The upper side of the thin ends of individual electrode 35, disposed in the region on the upper side from straight line A-A connecting the midpoints of the oblique lines of actuator unit 21, extends outward, and actuator terminal 36 is set up on the tip of that end. In addition, the bottom side of the thin ends of individual electrode 35, disposed in the region on the base side of straight line A-A, extends outward, and actuator terminal 36 is set up on the tip of that end. Actuator terminals 36 are disposed in a substantially matrix pattern. Each actuator terminal 36 is positioned so as to face a uniquely corresponding output terminal 75 of sheet 50, in a one-to-one correspondence. The distribution pattern of the actuator terminals 36 and the distribution pattern of output terminals 75 of sheet 50 are identical.

Further, disposed on each corner section of actuator unit 21 is common electrode terminal 37 electrically connected to common electrode 34 via a plurality of through-hole electrodes formed so as to penetrate piezoelectric sheet 41. As described hereinafter, common electrode 34 is grounded via common electrode terminal 37 and sheet 50. Accordingly, common electrode 34 is maintained at constant voltage in a region that corresponds to all pressure chambers 10. Further, each individual electrode 35 is electrically connected to a uniquely corresponding output contact of driver IC 80 via actuator terminal 36 and sheet 50, and its electric potential can be selectively controlled by driver IC 80.

Figure 8:
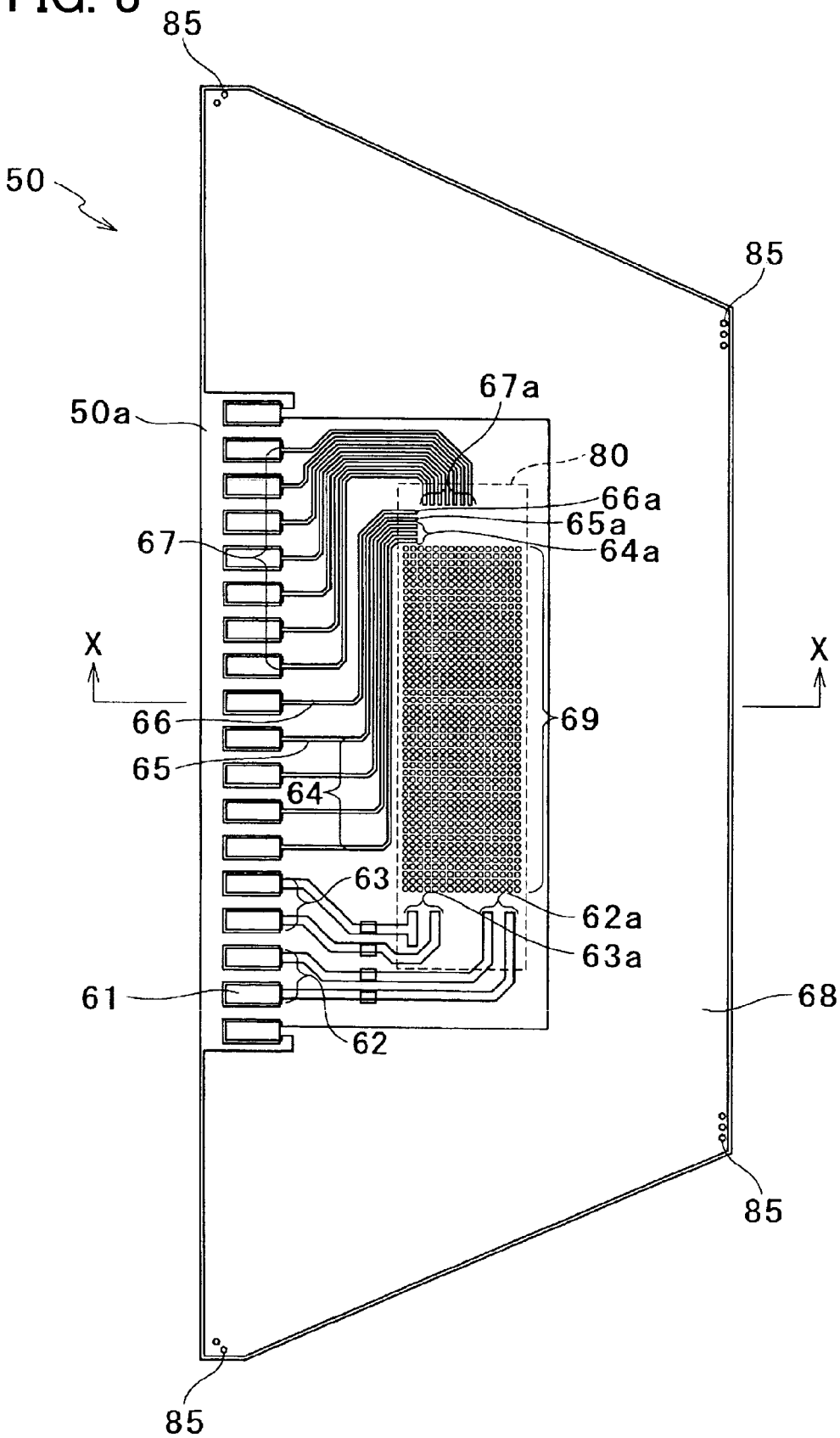
FIG. 8 shows a top planar view of the sheet shown in FIG. 2. The driver IC to be mounted on the sheet is omitted in FIG. 8.
Figure 9:
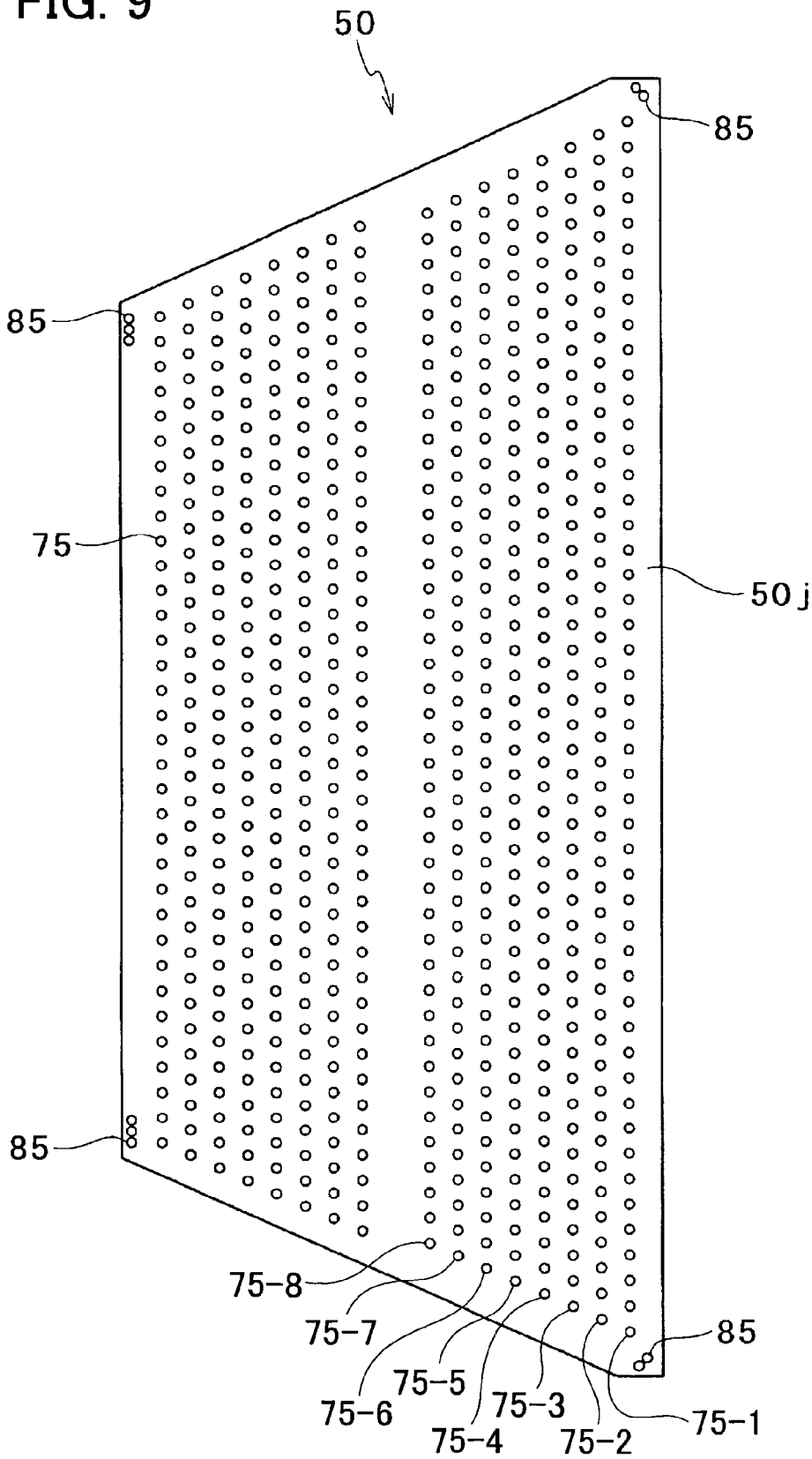
FIG. 9 shows a bottom planar view of the sheet shown in FIG. 2. The actuator unit is to be attached to the bottom surface of the sheet.
Figure 10:
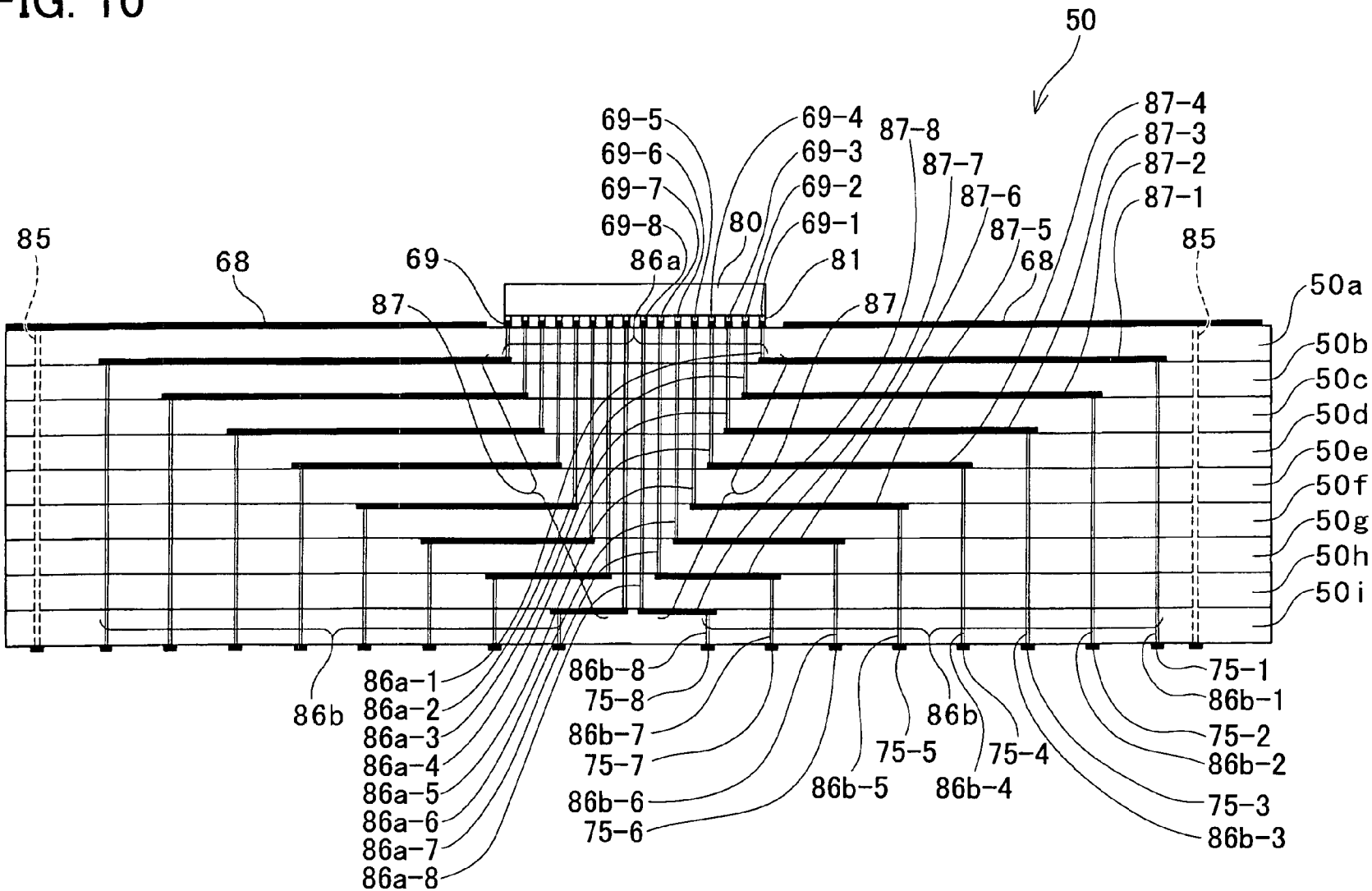
FIG. 10 shows a cross-sectional view along line X-X shown in FIG. 8.

Next, sheet 50 will be described with reference to FIGS. 8 to 10. FIG. 8 shows a top planar view of sheet 50 (showing upper surface or first surface of sheet 50) for mounting driver IC 80. In FIG. 8, driver IC 80 is shown with broken lines. FIG. 9 shows a bottom planar view of sheet 50 for fixing to actuator unit 21 (showing bottom surface or second surface of sheet 50). FIG. 10 shows a cross-sectional view along line X-X shown in FIG. 8. As shown in FIG. 10, sheet 50 bears a multi-layered structure with nine trapezoidal glass epoxy thin sheets stacked on top of one another, and comprises first layer 50*a* to ninth layer 50*i* between the mounting surface (upper surface or first surface) and the attachment surface (bottom surface or second surface). Wiring pattern is formed on each surface of first layer 50*a* to ninth layer 50*i*. Vertical wirings that penetrate first layer 50*a* to ninth layer 50*i* are also formed.

As shown in FIG. 8, driver IC 80 is mounted at the central portion of the upper surface of first layer 50*a* which is the first surface of sheet 50. Formed on the upper surface of first layer 50*a* is a plurality of input terminals 61 to be connected to contacts of FFC 51. Input terminals 61 are connected to 20V power lines 62 to drive actuator unit 21, 3.3V power lines 63 to drive driver IC 80, three serial control-wirings 64 to control driver IC 80, clock wiring 65, strobe wiring 66, and wave pattern wirings 67 to transmit a wave pattern of a driving signal to supply to individual electrode 35. 20V power lines 62, 3.3V power lines 63, serial control-wirings 64, clock wiring 65, strobe wiring 66, and wave pattern wirings 67 are formed on the upper surface of first layer 50*a*. Formed on the ends of 20V power lines 62, 3.3V power lines 63, serial control-wirings 64, clock wiring 65, strobe wiring 66, and wave pattern wirings 67 are first intermediate terminals 62*a*, 63*a*, 64*a*, 65*a*, 66*a*, and 67*a*. These first intermediate terminals 62*a*, 63*a*, 64*a*, 65*a*, 66*a*, and 67*a*, when driver IC 80 is mounted on the upper surface of sheet 50, conducts with corresponding input contacts of driver IC 80. 20V power lines 62, 3.3V power lines 63, serial control-wirings 64, clock wiring 65, strobe wiring 66, and wave pattern wirings 67 are first wirings that connect input terminals 61 of sheet 50 to the input contacts of driver IC.

Grounding-wiring 68 to connect to common electrode 34 is formed on the upper surface of sheet 50. Grounding-wiring 68 is connected to both end input terminals 61, and is formed to cover the almost entire area of the first surface of sheet 50 except for regions where input terminals 61, driver IC 80, and first wirings 62~67 are formed. Further, grounding-wiring 68 is connected to through-hole 85 formed so as to penetrate sheet 50. The voltage of the grounding-wiring 68 is maintained at a constant voltage by grounding.

As shown in FIG. 10, a plurality of output contacts 81 is formed on the bottom surface of driver IC 80. The number of output contacts 81 is equal to the numbers of nozzles 8, pressure chambers 10, individual electrodes 35, and actuator terminals 36. Output contacts 81 are disposed in a substantially matrix pattern.

As shown in FIG. 8, a plurality of second intermediate terminals 69 is formed on the upper surface of sheet 50. Second intermediate terminals 69 are formed in the same positional pattern as the positional pattern of output contacts 81 of driver IC 80. As shown in FIG. 10, when driver IC 80 is mounted on the upper surface of sheet 50, each output contact 81 becomes connected to a uniquely corresponding second intermediate terminal 69.

Driver IC 80 receives a serial signal transmitted from three serial control-wirings 64, converts the serial signal to driving signals through a serial-parallel conversion installed within driver IC 80 and outputs the driving signals from the out contacts 81. Driver IC 80 can select an arbitrary output contact from the plurality of output contacts 81, and can output driving voltage from the selected output contact. The driving signals are transmitted to sheet 50 though output contacts 81 and second intermediate terminals 69.

As shown in FIG. 9 and FIG. 10, a plurality of output terminals 75 is formed on a bottom surface of ninth layer 50*i*, which is the attachment surface (the second surface or bottom surface) of sheet 50. The plurality of output terminals 75 is configured in the same alignment as the alignment pattern of the plurality of actuator terminals 36 (FIG. 7) of actuator unit 21. When the attachment surface of sheet 50 is fixed onto the upper surface of actuator unit 21, each output terminal 75 becomes connected to a uniquely corresponding actuator terminal 36 of actuator unit 21.

Second intermediate terminals 69 formed on the upper surface of sheet 50 and output terminals 75 formed on the bottom surface of sheet 50 are connected by second wirings. When sheet 50 is viewed from a top, the locations of second intermediate terminals 69 and output terminals 75 do not match up with each other.

As shown in FIG. 9, eight rows of output terminals 75 exist on one side of actuator unit 21. As shown in FIG. 10, wiring 87-1 to connect to output terminals 75-1 of a first row are formed on a surface of insulating layer 50-*b*. Wiring 87-2 to connect to output terminals 75-2 of the second row are formed on a surface of insulating layer 50-*c*. Wiring 87-3 to connect to output terminals 75-3 of the third row are formed on a surface of insulating layer 50-*d*. Wiring 87-4 to connect to output terminals 75-4 of the fourth row are formed on a surface of insulating layer 50-*e*. Wiring 87-5 to connect to output terminals 75-5 of the fifth row are formed on a surface of insulating layer 50-*f*. Wiring 87-6 to connect to output terminals 75-6 of the sixth row are formed on a surface of insulating layer 50-*g*. Wiring 87-7 to connect to output terminals 75-7 of the seventh row are formed on a surface of insulating layer 50-*h*. Wiring 87-8 to connect to output terminals 75-8 of the eighth row are formed on a surface of insulating layer 50-*i*.

As shown in FIG. 10, wirings 87-1 for the first row are connected to second intermediate terminals 69-1 for the first row by utilizing through-holes 86*a*-1, and are connected to output terminals 75-1 of the first row by utilizing through-holes 86*b*-1. Wirings 87-2 for the second row are connected to second intermediate terminals 69-2 for the second row by utilizing through-holes 86*a*-2, and are connected to output terminals 75-2 of the second row by utilizing through-holes 86*b*-2. Wirings 87-3 for the third row are connected to second intermediate terminals 69-3 for the third row by utilizing through-holes 86*a*-3, and are connected to output terminals 75-3 of the third row by utilizing through-holes 86*b*-3. Wirings 87-4 for the fourth row are connected to second intermediate terminals 69-4 for the fourth row by utilizing through-holes 86*a*-4, and are connected to output terminals 75-4 of the fourth row by utilizing through-holes 86*b*-4. Wiring 87-5 for the fifth row are connected to second intermediate terminals 69-5 for the fifth row by utilizing through-holes 86*a*-5, and are connected to output terminals 75-5 of the fifth row by utilizing through-holes 86*b*-5. Wiring 87-6 for the sixth row are connected to second intermediate terminals 69-6 for the sixth row by utilizing through-holes 86*a*-6, and are connected to output terminals 75-6 of the sixth row by utilizing through-holes 86*b*-6. Wiring 87-7 for the seventh row are connected to second intermediate terminals 69-7 for the seventh row by utilizing through-holes 86*a*-7, and are connected to output terminals 75-7 of the seventh row by utilizing through-holes 86*b*-7. Wiring 87-8 for the eighth row are connected to second intermediate terminals 69-8 for the eighth row by utilizing through-holes 86*a*-8, and are connected to output terminals 75-8 of the eighth row by utilizing through-holes 86*b*-8.

The number of second wirings is greater than the number of first wirings 62~67 connected to input terminals 61 on first layer 50*a*.

Figure 11:
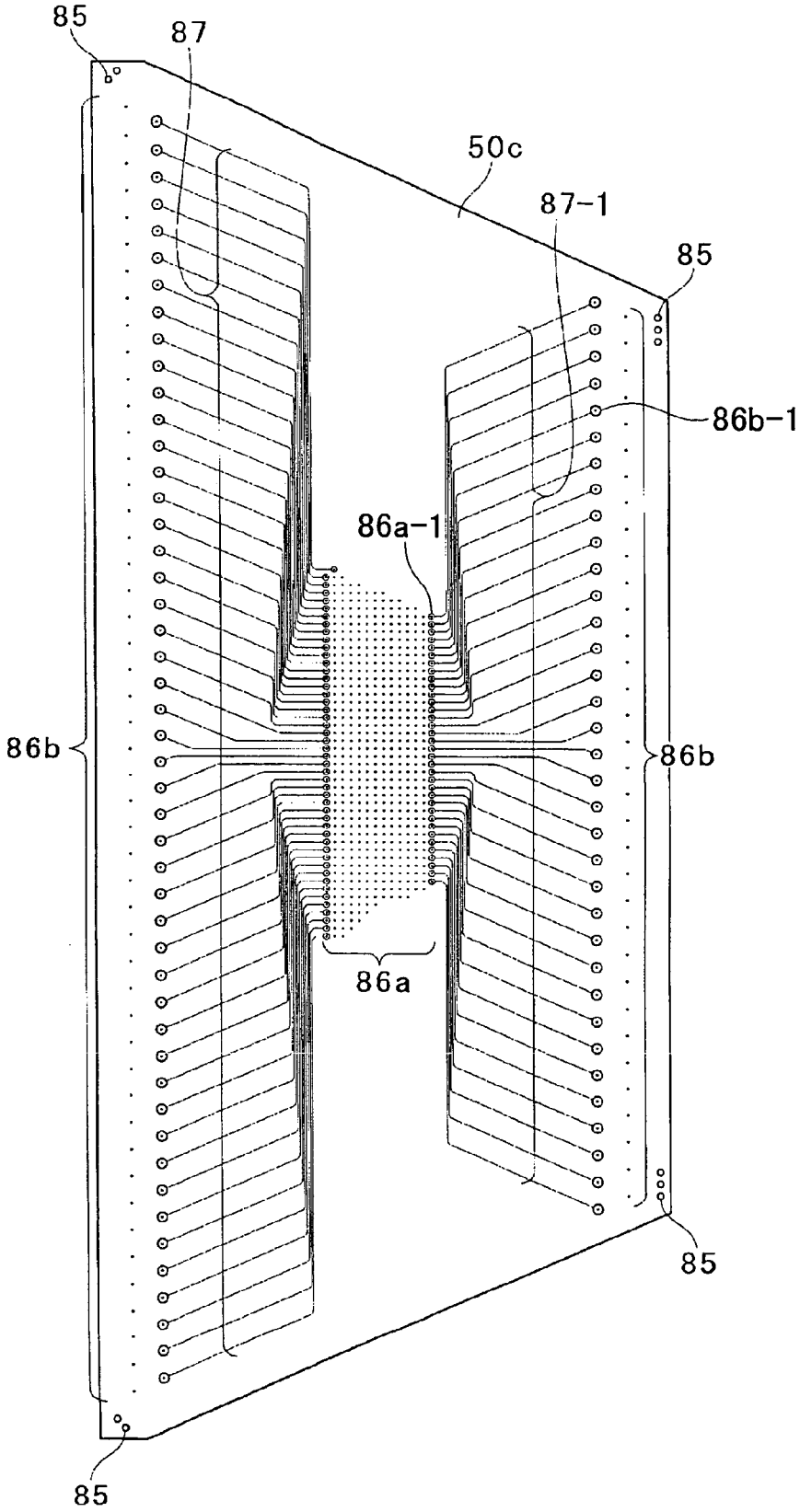
FIG. 11 shows a top planar view of a second layer of the sheet shown in FIG. 10.
Figure 12:
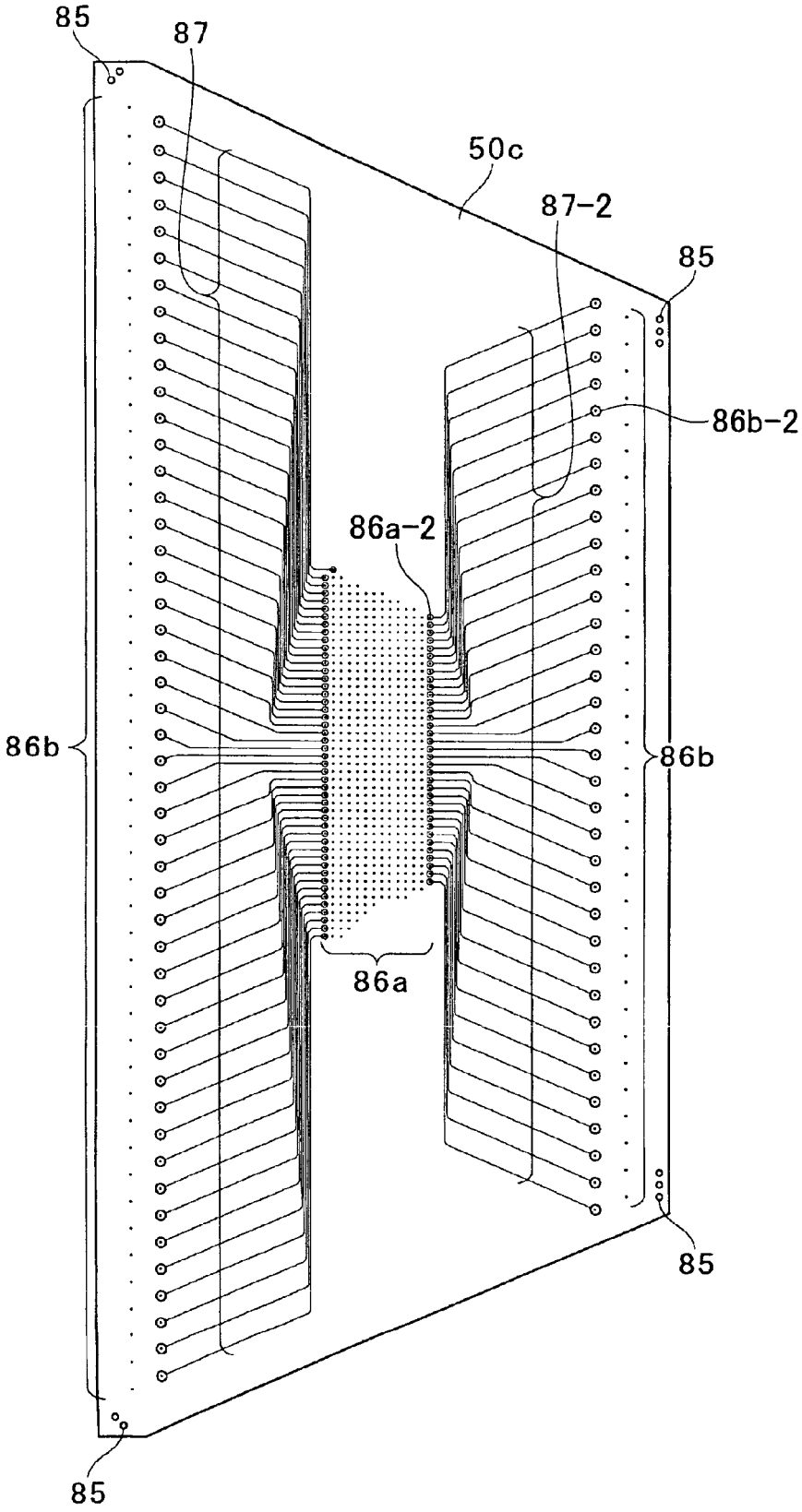
FIG. 12 shows a top planar view of a third layer of the sheet shown in FIG. 10.
Figure 13:
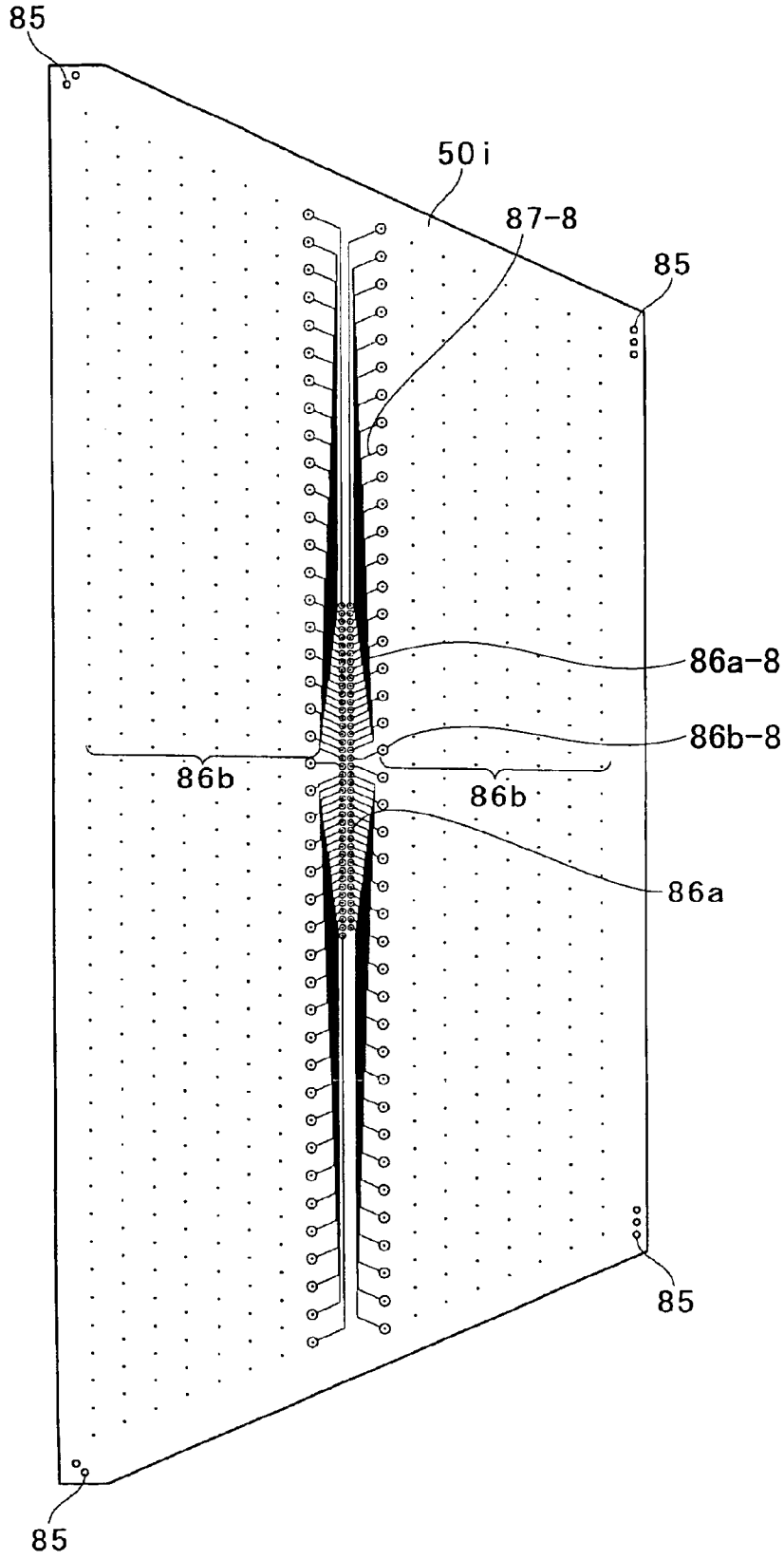
FIG. 13 shows a top planar view of a ninth layer of the sheet shown in FIG. 10.

Next, second wirings 86*a* and 86*b* formed on the through-hole of the insulating layers and second wiring 87 formed on a surface of the insulating layer will be described in detail with reference to FIGS. 11 to 13. FIG. 11 shows a top view of second layer 50*b* of sheet 50. FIG. 12 shows a top view of third layer 50*c* of sheet 50. FIG. 13 shows a top view of ninth layer 50*i* of sheet 50. Second intermediate terminals 69 are formed on the top surface of sheet 50 to contact with output contacts 81 formed on the bottom surface of driver IC 80.

As shown in FIG. 11, second wirings 86*a*-1 penetrate layer 50*a* from second intermediate terminals 69-1 for the first row and reach an upper surface of layer 50*b*. Lower ends of second wirings 86*a*-1 at the upper surface of layer 50*b* are connected to one ends of second wirings 87-1. The other ends of second wirings 87-1 are connected to second wirings 86*b*-1 penetrating layers 50*b*~50*i* and reaching output terminals 75-1 for the first row formed on the bottom surface of layer 50*i*.

As shown in FIG. 12, second wirings 86*a*-2 penetrate layers 50*a* and 50*b* from second intermediate terminals 69-2 for the second row and reach an upper surface of layer 50*c*. Lower ends of second wirings 86*a*-2 at the upper surface of layer 50*c* are connected to one ends of second wirings 87-2. The other ends of second wirings 87-2 are connected to second wirings 86*b*-2 penetrating layers 50*c*~50*i* and reaching output terminals 75-2 for the second row formed on the bottom surface of layer 50*i*.

Similarly, second wirings 86*a*-3 penetrate layers 50*a* to 50*c* from second intermediate terminals 69-3 for the third row and reach an upper surface of layer 50*d*. Lower ends of second wirings 86*a*-3 at the upper surface of layer 50*d* are connected to one ends of second wirings 87-3. The other ends of second wirings 87-3 are connected to second wirings 86*b*-3 penetrating layers 50*d*~50*i* and reaching output terminals 75-3 for the third row formed on the bottom surface of layer 50*i*.

Similarly, second wirings 86*a*-4 penetrate layers 50*a* to 50*d* from second intermediate terminals 69-4 for the forth row and reach an upper surface of layer 50*e*. Lower ends of second wirings 86*a*-4 at the upper surface of layer 50*e* are connected to one ends of second wirings 87-4. The other ends of second wirings 87-4 are connected to second wirings 86*b*-4 penetrating layers 50*e*~50*i* and reaching output terminals 75-4 for the fourth row formed on the bottom surface of layer 50*i*.

Similarly, second wirings 86*a*-5 penetrate layers 50*a* to 50*e* from second intermediate terminals 69-5 for the fifth row and reach an upper surface of layer 50*f*. Lower ends of second wirings 86*a*-5 at the upper surface of layer 50*f* are connected to one ends of second wirings 87-5. The other ends of second wirings 87-5 are connected to second wirings 86*b*-5 penetrating layers 50*f*~50*i* and reaching output terminals 75-5 for the fifth row formed on the bottom surface of layer 50*i*.

Similarly, second wirings 86*a*-6 penetrate layers 50*a* to 50*f* from second intermediate terminals 69-6 for the sixth row and reach an upper surface of layer 50*g*. Lower ends of second wirings 86*a*-6 at the upper surface of layer 50*g* are connected to one ends of second wirings 87-6. The other ends of second wirings 87-6 are connected to second wirings 86*b*-6 penetrating layers 50*g*~50*i* and reaching output terminals 75-5 for the sixth row formed on the bottom surface of layer 50*i*.

Similarly, second wirings 86*a*-7 penetrate layers 50*a* to 50*g* from second intermediate terminals 69-7 for the seventh row and reach an upper surface of layer 50*h*. Lower ends of second wirings 86*a*-7 at the upper surface of layer 50*h* are connected to one ends of second wirings 87-7. The other ends of second wirings 87-7 are connected to second wirings 86*b*-7 penetrating layers 50*h*~50*i* and reaching output terminals 75-7 for the seventh row formed on the bottom surface of layer 50*i*.

As shown in FIG. 13, second wirings 86*a*-8 penetrate layers 50*a* to 50*h* from second intermediate terminals 69-8 for the eighth row and reach an upper surface of layer 50*i*. Lower ends of second wirings 86*a*-8 at the upper surface of layer 50*i* are connected to one ends of second wirings 87-8. The other ends of second wirings 87-8 are connected to second wirings 86*b*-8 penetrating layer 50*i* and reaching output terminals 75-8 for the eighth row formed on the bottom surface of layer 50*i*.

Sheet 50 comprises a large number of wirings (second wirings) that correspond to the large number of the output contacts 81 of driver IC 80 and the large number of output terminals 75 of sheet 50. The large number of second wirings connects driver IC 80 and actuator unit 21. These large numbers of second wirings is distributed among first layer 50*a* to ninth layer 50*i*, formed by stacking a plurality of glass epoxy sheets. Therefore, since the second wirings formed on each layer (especially second wirings 87-1~87-8 which extend over each surface of second layers 50*b*~50*i*) can be formed with less density, the process of pattern formation becomes less difficult and becomes less expensive to manufacture. The sheet 50 may be flexible or rigid.

Next, a driving method of actuator unit 21 will be described. The direction of polarization of piezoelectric sheet 41 on actuator unit 21 is in the thick direction. In other words, actuator unit 21 is of a so-called unimorph-type configuration with a first upper layer (in other words, away from pressure chamber 10), piezoelectric sheet 41, as an active layer, and three bottom layers (in other words, near pressure chamber 10), piezoelectric sheets 42~44, as inactive layers. Therefore, when a selected individual electrode 35 is set to the predefined electric potential of either positive or negative, for example, a section interposed between the selected individual electrode 35 and common electrode 34 within piezoelectric sheet 41 where the electric field is impressed acts as the active section, and due to the piezoelectric transversal effect, it shrinks in the direction orthogonal to the polarization direction. On the other hand, piezoelectric sheets 42~44 do not shrink on their own since they are not affected by the electric field. Accordingly, between piezoelectric sheet 41 which is the upper layer and piezoelectric sheets 42~44 which are the bottom layers, a difference in distortion in the perpendicular direction of the direction of polarization results, and piezoelectric sheets 41~44 in its entirety tries to change shape as to protrude towards the inactive side (unimorph deformation). At this time, as shown in FIG. 6(*a*), since the bottom surface of piezoelectric sheets 41~44 is fixed on the upper surface of cavity plate 22, which divides the pressure chambers, the piezoelectric sheets 41~44 consequently deform to protrude towards the pressure chamber side. Further, volume of pressure chamber 10 decreases, pressure on the ink increases, and ink is discharged from nozzle 8. Then, when individual electrode 35 is placed back to the same electric potential as common electrode 34, piezoelectric sheets 41~44 suck in the ink from the sub-manifold channel 5*a* side because the sheets 41~44 return to their original shapes and the volume of pressure chamber 10 returns to it original volume. Individual actuator is formed by a set of individual electrode 35, common electrode 34, and piezoelectric sheets 41~44 interposed between the individual electrode 35 and common electrode 34. The actuator unit 21 includes a plurality of individual actuators.

According to the first embodiment described above, since sheet 50, which mounts driver IC 80, is directly attached to actuator unit 21, it is no longer necessary to use an expensive FPC with a large number of wiring patterns corresponding to the number of densely disposed individual electrodes. Ink jet head 1, bearing densely disposed channels and nozzles, can be manufactured less expensively.

Additionally, since grounding-wiring 68 is formed so as to cover the entire area except for regions where input terminals 61, driver IC 80, and first wirings 62~67 are formed, electromagnetic noise generated from actuator unit 21 can be shielded more effectively.

Further, sheet 50 comprises first layer 50*a* to ninth layer 50*i*, and each second intermediate terminal 69 and the uniquely corresponding output terminal 75 are electrically connected via second wirings 86*a* and 86*b*, which extend in the thick direction of sheet 50 through through-holes, and second wiring 87, which extends along the upper surface of second layer 50*b* to ninth layer 50*i*. As a result, the region where second wirings 86*a*, 86*b*, and 87 are formable can be broadly maintained. In addition, even if spacing between adjacent second intermediate terminals 69 is smaller than spacing between adjacent actuator terminals 36 of actuator unit 21, they can be made to conduct with each other without fail. In addition, since second wirings 86*a*, 86*b*, and 87 are distributed and formed on first layer 50*a* to ninth layer 50*i*, the wirings on each layer can be formed less densely, and each layer becomes less expensive to manufacture.

In addition, since output terminals 75 to be connected to actuator terminals 36 of actuator unit 21 are disposed in a matrix pattern on ninth layer 50*i* of sheet 50, a simple wiring pattern can be formed on sheet 50.

Further, since driver IC 80 is mounted at the central portion of first layer 50*a*, the pitch between wirings within sheet 50 can be expanded.

Further, since driver IC 80 is thermally coupled to ink reservoir unit 71 via heat dissipating sheet 82, heat generated by driver IC 80 can be efficiently dissipated via ink reservoir unit 71 through which ink flows. In addition, a miniaturization of ink jet head 1 can be realized because there is no need to provide a separated heat-dissipating fin or block.

In addition, since actuator unit 21 and sheet 50 are disposed within gap 71*a*, and since gap 71*a* is sealed with silicon 84, actuator unit 21 and sheet 50 can be protected from ink-spray and dust.

Further, since actuator unit 21 is individually fixed on the channel unit, even if there is misalignment in the fixing position of actuator unit 21 to correspond to channel unit 4, sheet 50 can still be accurately fixed on each actuator unit 21.

Second Embodiment

Next, an ink jet head of a second embodiment of the present invention will be described with reference to FIG. 14. With regards to the figures of the second embodiment, members that are the same as those from the first embodiment will be represented with the same notation and their explanation will be omitted.

Figure 14:
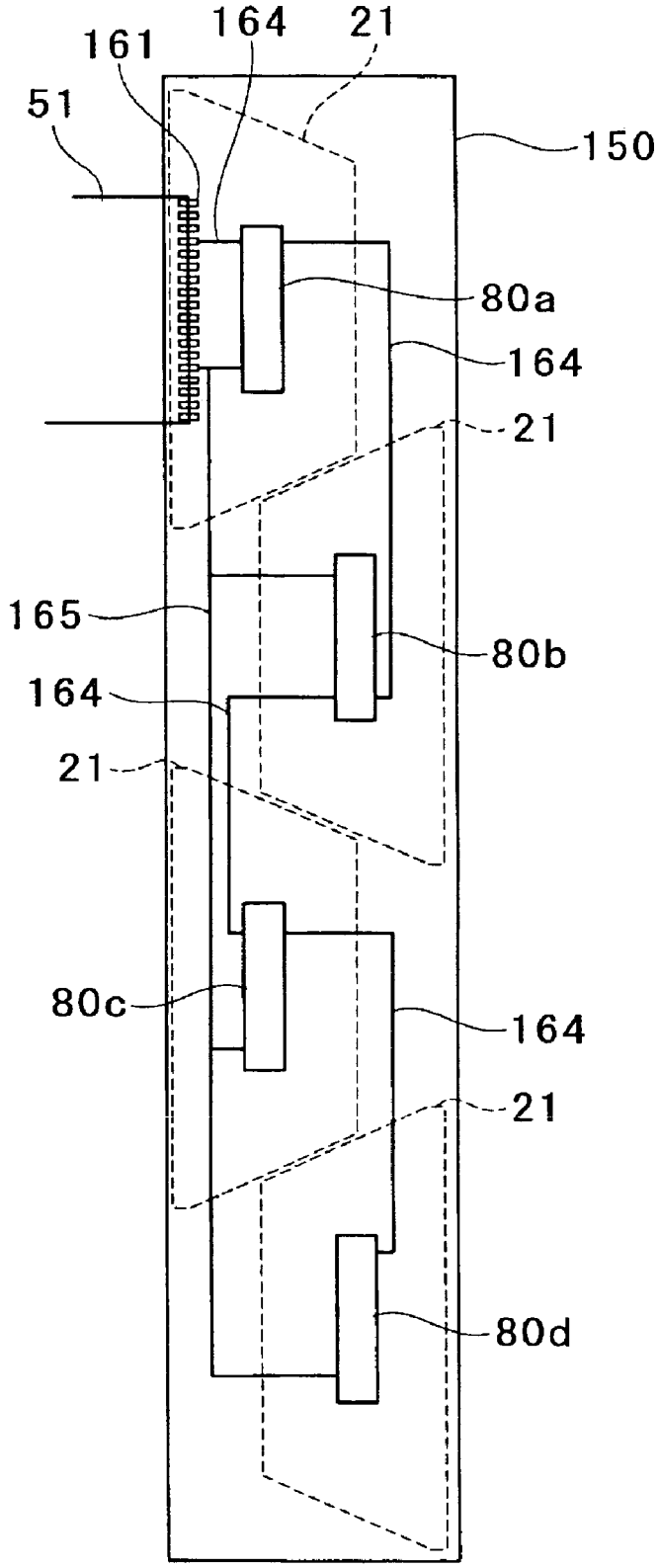
FIG. 14 shows a top planar view of a sheet of a second embodiment of the present invention.

FIG. 14 shows a planar view of sheet 150, which provides ink jet head 101 of the second embodiment. Sheet 150 is a stacked sheet made of glass epoxy, and as shown in FIG. 14, it bears a rectangular shape extending in one direction, and is fixed so as to be in common with four actuator units 21. On top of sheet 150, four driver ICs 80*a*~80*d* are mounted in a zigzag fashion. On the mounting surface of sheet 150, mounting four driver ICs 80*a*~80*d*, input terminals 161 to be connected to contacts of FPC 51 are aligned. A set of input terminals 161 is disposed along the longitudinal direction of driver IC 80*a*. In addition, serial control-wirings 164 are connected to driver ICs 80*a*~80*d* in a cascade connection from input terminal 161. That is serial control-wirings 164 connects input terminals 161, driver ICs 80*a*, driver ICs 80*b*, driver ICs 80*c*, and driver ICs 80*d* in series. Clock and strobe wirings 165 are diverged into four from input terminal 161 and connected to each driver ICs 80*a*~80*d* in parallel. Serial control-wirings 164 and clock and strobe wirings 165 are formed on the mounting surface of sheet 150. Serial control-wirings 164 and clock strobe wirings 165 are simplified in FIG. 14. Further, second intermediate terminals 69 to be connected to output contacts 181 of driver ICs 80 are formed on the mounting surface of sheet 150 (refer to FIG. 8).

On an attachment surface of sheet 150 to attach with actuator unit 21, output terminals 75 to be connected to actuator terminals 36 of actuator unit 21 are disposed in a matrix pattern to correspond to each actuator unit 21 (refer to FIG. 9). Then, each second intermediate terminal 69 and corresponding output terminal 75 are electrically connected by a wiring formed on a middle layer of sheet 150. Details will be omitted because the configuration is similar to the first embodiment.

According to the second embodiment described above, since driver ICs 80*a*~80*d* are connected in cascade connection by serial control-wirings 164, the number of input terminals 161 and FPCs 51 can be reduced. Therefore, a reduction in the cost of manufacturing an ink jet head can be realized.

Further, since the configuration provides one sheet 150 for four actuator units 21, a reduction in the cost of manufacturing sheet 150 can be realized.

Figure 15:
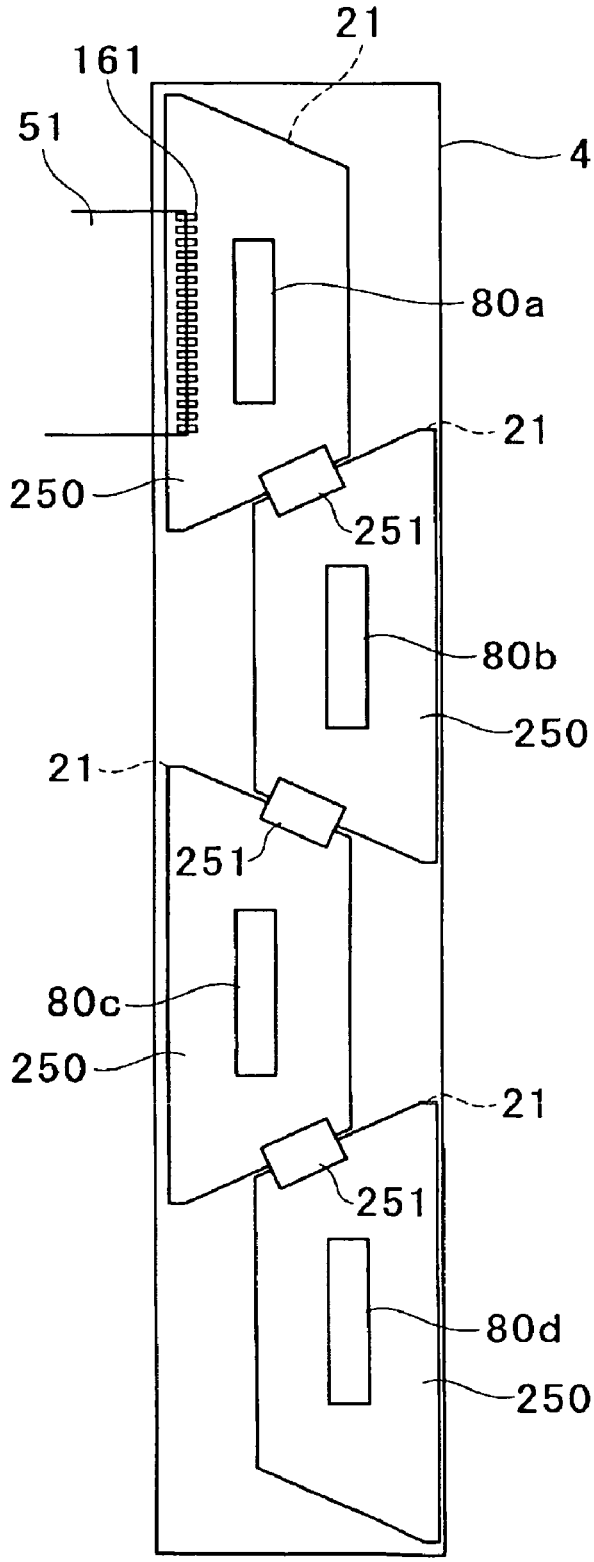
FIG. 15 shows a top planar view of sheets of a transfiguration example of the sheet shown in FIG. 14.

The configuration of the present embodiment provides one sheet 150 for four actuator units 21, but the configuration is not limited to this. For example, as shown in FIG. 15, a configuration may provide sheet 250 for each actuator unit 21. In this case, connecting-cables 251, to connect serial connection-wirings and clock strobe wirings between adjacent sheets 250, are provided. Accordingly, even if there is misalignment in the fixing position of actuator unit 21 for channel unit 4, sheet 50 can be accurately fixed on each actuator unit 21.

A preferred embodiment of the present invention has been explained, but the present invention is not limited to the embodiment described above, and various modifications in the design are possible within the scope of the described claims. For example, according to the first embodiment, grounding-wiring 68 is configured so as to cover the entire area except for regions where input terminals 61, driver IC 80, and first wirings 62~67 are formed, but grounding-wiring 68 may be of any pattern.

Further, in the first embodiment, sheet 50 is formed by stacking nine layers of glass epoxy sheets, but any number of glass epoxy sheets may be stacked to form sheet 50, and it may even be a single glass epoxy sheet. The sheet 50 may be flexible or rigid. The sheet 50 may be thin or thick. The sheet may be a board.

Further, in the first embodiment, driver IC 80 is mounted at the central portion of first layer 50*a*, but driver IC 80 may be mounted at any location.

In addition, in the first embodiment, driver IC 80 is thermally coupled to the bottom surface of ink reservoir unit 71 via heat dissipating sheet 82, but driver IC 80 does not need to be thermally coupled to ink reservoir unit 71, and it may be thermally coupled to other members such as a heat dissipating fin.

Further, in the first embodiment, actuator unit 21 and sheet 50 are disposed within gap 71*a*, and gap 71*a* is sealed with silicon 84, but actuator unit 21 and sheet 50 may be placed within an open space.

Further, the first embodiment provides actuator unit 21 that can individually apply pressure to the ink within the plurality of pressure chambers 10, but it may provide a separate actuator independently for each pressure chamber.

The actuator unit 21 is not restricted to a type that uses piezoelectric sheets. The actuator may equally well be type in which, on the basis of a signal sent from the driver IC 80, the ink in the pressure chamber is heated, a bubble is generated in the ink and the ink is pressed and discharged from the nozzle. In this case, the actuator may be a heat element for heating the ink.

In addition, in the first embodiment, sheet 50 is configured so that input terminals 61, 20V power lines 62, 3.3V power lines 63, serial control-wirings 64, clock wiring 65, strobe wiring 66, and wave pattern wirings 67 (first wiring) are formed on the upper surface of first layer 50*a*, which is the mounting surface of driver IC 80, but the configuration is acceptable if at least first intermediate terminals 62*a*~67*a* (refer to FIG. 8) to be connected to the input contacts of driver IC 80 are formed on the mounting surface. In this case, the configuration is acceptable if the section excluding input terminals 61 and first intermediate terminals 62*a*~67*a* of first wirings 62~67 are formed on second layer 50*b* to ninth layer 50*i* of sheet 50, and are configured so parts of first wirings 62~67 extend through through-holes.

What is claimed is:

1. An ink jet head comprising:

a main body comprising a channel unit, a reservoir unit configured to store ink supplied to the channel unit, a plurality of nozzles, a plurality of pressure chambers, a plurality of actuators, and a plurality of actuator terminals, wherein each nozzle is connected to a uniquely corresponding pressure chamber, each pressure chamber is coupled with a uniquely corresponding actuator, each actuator is connected to a uniquely corresponding actuator terminal, and when a driving voltage is applied to a selected actuator terminal, ink within the pressure chamber coupled with the actuator connected to the selected actuator terminal is pressed and ink is discharged from the nozzle connected to the pressure chamber;

a driver IC being configured to select any actuator terminal among the plurality of actuator terminals and transmit the driving voltage to the selected actuator terminal; and a sheet having a first surface and a second surface, the driver IC being mounted to the sheet at the first surface, and the sheet being fixed to the main body at the second surface, the sheet comprising a plurality of input terminals, a plurality of output terminals distributed on the second surface, a plurality of first wirings connecting the input terminals and the driver IC, and a plurality of second wirings connecting the driver IC and the output terminals, wherein the second wirings pass through the sheet from the first surface to the second surface, wherein each output terminal is connected to a uniquely corresponding actuator terminal, wherein the reservoir unit and the channel unit form a gap, and wherein the sheet is located in the gap.

2. The ink jet head as defined in claim 1, wherein the plurality of input terminals and the plurality of first wirings are formed on the first surface.

3. The ink jet head as defined in claim 2, wherein the sheet further comprises:

a constant voltage input terminal;

a constant voltage output terminal formed on the second surface; and a constant voltage wiring connecting the constant voltage input terminal and the constant voltage output terminal, wherein the constant voltage wiring passed through the sheet, and covers nearly an entire area of the first surface except the regions where the driver IC is mounted, the input terminals are formed, and the first wirings are formed.

4. The ink jet head as defined in claim 1, wherein a number of the second wirings is equal to a number of the nozzles, and is larger than a number of the first wirings.

5. The ink jet head as defined in claim 1, wherein the sheet comprises a plurality of stacked layers, and wherein a part of the second wirings is formed on a surface of each layer.

6. The ink jet head as defined in claim 1, wherein the actuator terminals are distributed on a surface of the main body to form a matrix pattern, and the output terminals is distributed on the second surface of the sheet to form the same matrix pattern.

7. The ink jet head as defined in claim 1, wherein the driver IC is mounted at a central portion of the first surface.

8. The ink jet head as defined in claim 1, wherein the main body further comprises an actuator unit fixed to the surface of the channel unit, and wherein the pressure chambers are formed on a surface of the channel unit.

9. The ink jet head as defined in claim 8, wherein the reservoir unit is fixed to the surface of the channel unit.

10. The ink jet head as defined in claim 9, wherein the actuator unit, and the driver IC are also located within the gap.

11. The ink jet head as defined in claim 10, wherein the gap is filled with a sealing material.

12. The ink jet head as defined in claim 8, wherein a plurality of actuator units is fixed to the channel unit, and wherein the sheet includes a plurality of driver ICs, each of the driver ICs is fixed to each actuator unit.

13. The ink jet head as defined in claim 12, wherein the driver ICs are connected in a cascade connection.

14. The ink jet head as defined in claim 8, wherein a plurality of actuator units is fixed to the channel unit, the sheet is fixed to the plurality of actuator units, and the sheet is mounting a plurality of driver ICs, wherein a number of the mounted driver ICs is equal to the number of the actuator units.

15. The ink jet head as defined in claim 14, wherein the driver ICs are connected in a cascade connection.

16. The ink jet head as defined in claim 1, wherein the driver IC is thermally coupled with the reservoir unit.

17. An ink jet head comprising:

a main body comprising a plurality of nozzles, a plurality of pressure chambers, a plurality of actuators, and a plurality of actuator terminals, wherein each nozzle is connected to a uniquely corresponding pressure chamber, each pressure chamber is coupled with a uniquely corresponding actuator, each actuator is connected to a uniquely corresponding actuator terminal, wherein the actuator terminals are distributed on a surface of the main body to form matrix pattern and when a driving voltage is applied to a selected actuator terminal, ink within the pressure chamber coupled with the actuator connected to the selected actuator terminal is pressed and ink is discharged from the nozzle connected to the pressure chamber;

a driver IC comprising a plurality of input contacts, and a plurality of output contacts distributed on a surface of the driver IC, wherein the driver IC is configured to select any output contact among the plurality of output contacts and transmit the driving voltage to the selected output contact; and a sheet having a first surface and a second surface, the driver IC being mounted at the first surface of the sheet and the sheet being fixed to the main body at the second surface, the sheet comprising a plurality of stacked layers including a first insulating layer and a second insulating layer, a plurality of input terminals, a plurality of first intermediate terminals distributed on the first surface, a plurality of second intermediate terminals distributed on the first surface, a plurality of output terminals distributed on the second surface forming the same matrix pattern, a plurality of first wirings connecting the input terminals and the first intermediate terminals, a plurality of second wirings connecting the second intermediate terminals and the output terminals, wherein the second wirings pass through the sheet from the first surface to the second surface, and wherein a surface of the first insulating layer contacts a surface of the second insulating layer, wherein each first intermediate terminal is connected to a uniquely corresponding input contact of the driver IC, each output contact of the driver IC is connected to a uniquely corresponding second intermediate terminal, and each output terminal is connected to a uniquely corresponding actuator terminal of the main body, wherein a portion of the second wirings connected to the output terminals at a first row of the matrix pattern is formed on a surface of the first insulating layer, and wherein a portion of the second wirings connected to the output terminals at a second row of the matrix pattern is formed on a surface of the second insulating layer.

18. The ink jet head as defined in claim 17, wherein a number of the second wirings is larger than a number of the first wirings.

19. The ink jet head as defined in claim 18, wherein a number of the output contacts, a number of the second intermediate terminals, a number of the second wirings, a number of the output terminals and a number of the actuator terminals are equal.

20. The ink jet head as defined in claim 17, wherein a part of the second wirings formed on a surface of an n-th insulating layer is connected to the second intermediate terminals via through holes penetrating first to (n−1)-th insulating layers and connected to the output terminals via through holes penetrating (n+1)-th to m-th insulating layers, wherein "m" is the total number of the insulating layers and "n" is any number selected from "1" to "m".

21. An ink jet head comprising:

a main body including:

a plurality of nozzles, a plurality of pressure chambers, wherein each of the plurality of nozzles is connected to a corresponding pressure chamber, a plurality of actuators, wherein each pressure chamber is coupled with a uniquely corresponding actuator, and a plurality of actuator terminals, wherein each actuator is connected to a uniquely corresponding actuator terminal such that when a driving voltage is applied to a selected actuator terminal, ink in the pressure chamber corresponding to the actuator connected to the selected actuator terminal is pressed, wherein the plurality of actuator terminals are distributed on a surface of the main body to form a matrix pattern;

a driver IC configured to select the selected actuator terminal and to transmit the driving voltage to the selected actuator terminal; and a sheet including:

a first surface and a second surface, wherein the driver IC is mounted on a first surface of the sheet and wherein the sheet is fixed to the main body on the second surface, a plurality of stacked insulating layers including a first insulating layer and a second insulating layer, wherein a surface of the first insulating layer contacts a surface of the second insulating layer, a plurality of output terminals distributed on the second surface forming the same matrix pattern as the plurality of actuator terminals, and a plurality of wirings connecting the driver IC and the output terminals, wherein a first portion of the wirings are formed on the surfaces of the plurality of stacked insulating layers and wherein a second portion of the wirings pass through the plurality of stacked insulating layers of the sheet from the first surface to the second surface, wherein a third portion of the wirings connected to the output terminals at a first row of the matrix pattern is formed on a surface of the first insulating layer, and wherein a fourth portion of the wirings connected to the output terminals at a second row of the matrix pattern is formed on a surface of the second insulating layer.

* * * * *